US006187525B1

(12) United States Patent
Maskasky et al.

(10) Patent No.: US 6,187,525 B1
(45) Date of Patent: Feb. 13, 2001

(54) COLOR PHOTOGRAPHIC ELEMENTS OF INCREASED SENSITIVITY CONTAINING ONE EQUIVALENT COUPLER

(75) Inventors: Joe E. Maskasky; Kenneth J. Reed; Victor P. Scaccia; James A. Friday, all of Rochester, NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/213,766

(22) Filed: Dec. 17, 1998

(51) Int. Cl.[7] ..... G03C 1/08; G03C 7/26; G03C 7/32

(52) U.S. Cl. ..... 430/546; 430/567; 430/569; 430/639; 430/641; 430/543; 430/359; 430/226; 430/958; 430/570; 430/572; 430/577; 430/583; 430/584; 430/588; 430/599

(58) Field of Search ..... 430/567, 569, 430/639, 641, 543, 359, 226, 958, 570, 572, 577, 583, 584, 588, 599, 546

(56) References Cited

U.S. PATENT DOCUMENTS

| | | | | |
|---|---|---|---|---|
| 4,439,520 | | 3/1984 | Kofron et al. | 430/434 |
| 4,840,884 | | 6/1989 | Mooberry et al. | 430/557 |
| 5,447,819 | | 9/1995 | Mooberry et al. | 430/226 |
| 5,457,004 | | 10/1995 | Mooberry et al. | 430/226 |
| 5,604,085 | | 2/1997 | Maskasky | 430/567 |
| 5,612,173 | * | 3/1997 | Proehl et al. | 430/543 |
| 5,620,840 | | 4/1997 | Maskasky | 430/567 |
| 5,667,955 | | 9/1997 | Maskasky | 430/567 |
| 5,691,131 | | 11/1997 | Maskasky | 430/639 |
| 5,693,459 | * | 12/1997 | Maskasky | 430/567 |
| 5,733,718 | | 3/1998 | Maskasky | 430/639 |
| 5,747,235 | | 5/1998 | Farid et al. | 430/583 |
| 5,747,236 | | 5/1998 | Farid et al. | 430/583 |
| 6,010,841 | * | 1/2000 | Farid et al. | 430/583 |

OTHER PUBLICATIONS

*Research Disclosure*, vol. 389, Sep. 1996, Item 38957, I., II., IV., V., and X.

Color Photography, *The Kirk–Othmer Encyclopedia of Chemical Technology—Fourth Ed. John Wiley and Sons*, New York, 1993; vol. 6.

* cited by examiner

*Primary Examiner*—Geraldine Letscher
(74) *Attorney, Agent, or Firm*—Edith A. Rice

(57) ABSTRACT

A photographic recording element is disclosed containing in at least one dye image forming layer unit (a) a radiation-sensitive silver halide grains include tabular grains (1) having {111} major faces, (2) containing greater than 50 mole percent bromide, based on silver, and (3) accounting for greater than 50 percent total grain projected area, (b) a fragmentable electron donating sensitizer, (c) a water dispersible cationic starch peptizer, and (d) a one equivalent dye image providing coupler. Increased photographic speed is realized.

12 Claims, No Drawings

COLOR PHOTOGRAPHIC ELEMENTS OF INCREASED SENSITIVITY CONTAINING ONE EQUIVALENT COUPLER

FIELD OF THE INVENTION

The invention relates to color photography. More specifically, the invention relates to color photographic elements that contain layer units that contain radiation-sensitive silver halide emulsions and produce dye images.

BACKGROUND OF THE INVENTION

The most widely used forms of photographic elements are those that contain one or more silver halide emulsions. Silver halide emulsions are usually prepared by precipitating silver halide in the form of discrete grains (microcrystals) in an aqueous medium. An organic peptizer is incorporated in the aqueous medium to disperse the grains. Varied forms of hydrophilic colloids are known to be useful as peptizers, but the overwhelming majority of silver halide emulsions employ gelatino-peptizers. A summary of conventional peptizers, including gelatino-peptizers, is provided by *Research Disclosure,* Vol. 389, September 1996, Item 38957, II. Vehicles, vehicle extenders, vehicle-like addenda and vehicle related addenda, A. Gelatin and hydrophilic colloid peptizers. *Research Disclosure* is published by Kenneth Mason Publications, Ltd., Dudley House, 12 North St., Emsworth, Hampshire P010 7DQ, England. The term "vehicle" includes both the peptizer used to disperse silver halide grains as they are being formed and the binder used in coating emulsion and processing solution penetrable layers of photographic elements. Gelatin and gelatin derivatives are commonly employed to perform the functions of both peptizer and binder.

The characteristic that is primarily responsible for the dominance of silver halide photography is the image amplification capability of silver halide grains. During imagewise exposure of a silver halide photographic element, incident photons are absorbed by the silver halide grains. When a photon is absorbed, an electron in the silver halide crystal lattice structure of a grain is promoted from a valence band energy level to a higher, conduction band energy level at which it is capable of migrating within the crystal lattice of the grain. When a few conduction band electrons are captured by crystal lattice silver ions in close proximity, a cluster of $Ag^o$ atoms is created, commonly referred to as a latent image site. The latent image site of a grain is capable of catalyzing the overall reduction of silver ions in the grain to $Ag^o$, a huge amplification of the few original $Ag^+$ reductions to $Ag^o$ created by imagewise exposure. An imagewise exposed silver halide emulsion is brought into contact with a developer to produce a viewable image. A developer is an aqueous solution containing a developing agent, a reducing agent capable of selectively reducing latent image bearing silver halide grains to $Ag^o$. Contacting a photographic element with aqueous solutions, including a developer, to produce a viewable image is referred to as photographic processing.

Although many factors come into play in obtaining desirable photographic images, one of the most fundamental is the speed of the photographic element employed. While silver halide photography with its internal amplification mechanism exhibits much higher photographic speeds than other imaging systems, the search for higher photographic speeds in silver halide photography has continued since its inception to the present time, a time period of well over a century. The speed of a photographic element is measured by exposing sample portions of the element at differing levels and then correlating image density following photographic processing. By plotting image density (D) as an ordinate against the log of exposure (E) in lux-seconds, a characteristic curve is generated. The characteristic curve typically contains a portion that exhibits no change in density (minimum density or $D_{min}$) as a function of exposure transitioning with increased exposures to a portion in which density increases as a function of increased exposure, often resulting in a linear characteristic curve segment (i.e., $\Delta D/\Delta \log E$ remains constant) transitioning with still higher exposures to a portion in which further exposure does not increase density (maximum density or $D_{max}$). Photographic element speeds are usually reported as differences in log E required to produce the same density in compared elements.

Silver halide emulsions possess a native sensitivity to light having wavelengths ranging from the ultraviolet into the blue region of the visible spectrum. Spectral sensitizing dyes are adsorbed to the silver halide grain surfaces to extend sensitivity to longer wavelength portions of the spectrum. A summary of spectral sensitizing dyes is provided by *Research Disclosure,* Item 38957, cited above, V. Spectral sensitization and desensitization, A. Sensitizing Dyes. The function of a spectral sensitizer is to capture for latent image formation a photon of a wavelength the silver halide grain cannot itself capture.

To increase the speed of silver halide emulsions independent of spectral sensitization, the grain surfaces are treated with chemical sensitizers. A summary of chemical sensitizers is provided by *Research Disclosure,* Item 38957, cited above, IV. Chemical sensitization.

It has been recently recognized that a further enhancement in photographic speed can be realized by associating with the silver halide grain surfaces a fragmentable electron donating (FED) sensitizer. While no proof of the mechanism of FED sensitization has yet been generated, one plausible explanation is as follows: When, as noted above, photon capture within a grain results in electron promotion from a valence shell to a conduction energy band, a common loss factor is recombination. That is, the promoted electron simply returns to a hole in the valence shell, created by promotion to the conduction band of the same or another electron. When recombination occurs, the energy of the captured photon is dissipated without contributing to latent image formnation. It is believed that the FED sensitizer reduces recombination by donating an electron to fill the hole created by photon capture. Thus, fewer conduction band electrons return to hole sites in valence bands and more electrons are available to participate in latent image formation.

When the FED sensitizer donates an electron to a silver halide grain, it fragments, creating a cation and a free radical. The free radical is a single atom or compound that contains an unpaired valence shell electron and is for that reason highly unstable. If the oxidation potential of the free radical is equal to or more negative than −0.7 volt, the free radical immediately upon formation injects a second electron into the grain to eliminate its unpaired valence shell electron. When the free radical also donates an electron to the grain, it is apparent that absorption of a single photon in the grain has promoted an electron to the conduction band, stimulated the FED sensitizer to donate an electron to file the hole left behind by the promoted electron, thereby reducing hole-electron recombination, and injected a second electron. Thus, the FED sensitizer contributes one or two electrons to the silver grain that contribute directly or indirectly to latent image formation.

FED sensitizers and their utilization for increasing photographic speed are disclosed in Farid et al U.S. Pat. Nos. 5,747,235 and 5,7547,236, and in the following commonly assigned filings: Lenhard et al U.S. Ser. No. 08/739,911, filed Oct. 30, 1996, and Gould et al U.S. Ser. No. 09/118,536, Farid et al U.S. Ser. No. 09/118,552, and Adin et al U.S. Ser. No. 09/118,714, each filed Jun. 25, 1998.

A dramatic increase in photographic speeds in silver halide photography began with the introduction of tabular grain emulsions into silver halide photographic products in 1982. A tabular grain is one which has two parallel major faces that are clearly larger than any other crystal face and which has an aspect ratio of at least 2. The term "aspect ratio" is the ratio of the equivalent circular diameter (ECD) of the grain divided by its thickness (the distance separating the major faces). Tabular grain emulsions are those in which tabular grains account for greater than 50 percent of total grain projected area. Kofron et al U.S. Pat. No. 4,439,520 illustrates the first chemically and spectrally sensitized high aspect ratio (average aspect ratio>8) tabular grain emulsions. In their most commonly used form tabular grain emulsions contain tabular grains that have major faces lying in {111} crystal lattice planes and contain greater than 50 mole percent bromide, based on silver. A summary of tabular grain emulsions is contained in *Research Disclosure,* Item 38957, cited above, I. Emulsion grains and their preparation, B. Grain morphology, particularly sub-paragraphs (1) and (3).

The use of cationic starch as a peptizer for the precipitation of high bromide {111} tabular grain emulsions is taught by Maskasky U.S. Pat. Nos. 5,604,085, 5,620,840, 5,667,955, 5,691,131, and 5,733,718. Oxidized cationic starches are advantageous in exhibiting lower levels of viscosity than gelatino-peptizers. This facilitates mixing. Under comparable levels of chemical sensitization higher photographic speeds can be realized using cationic starch peptizers. Alternatively, speeds equal to those obtained using gelatino-peptizers can be achieved at lower precipitation and/or sensitization temperatures, thereby avoiding unwanted grain ripening.

When silver halide grains are developed, the light exposed (as opposed to the non-exposed) silver halide grains are selectively reduced with a developing agent. During this reaction silver halide is reduced to silver, and the developing agent is oxidized. When it is desired to form a dye image, the developing agent is usually chosen to be a color developing agent, which is a developing agent that, following oxidization, reacts to complete an image dye chromophore. The most common route to image dye formation is the reaction of an image dye-forming coupler with a para-phenylenediaamine color developing agent, which is a para-phenylenediamine in which at least one of the amine groups is unsubstituted. Dye chromophore formation occurs when one or two quinonediimine molecules (each of which requires two molecules of oxidized para-phenylenediamine color developing agent to produce) reacts with the image dye-forming coupler. When an image dye-forming coupler requires two quinonediimine molecules to form an image dye molecule, the image dye-forming coupler is said to be a four equivalent coupler, since four molecules of color developing agent must be oxidized to result in each molecule of image dye. Two equivalent coupler image dye-forming couplers are those that spontaneously split off an anionic (e.g., halogen) or low pKa leaving group (e.g., phenol or heterocycle) under the conditions of development and therefore react with a single quinonediimine molecule to form an image dye molecule. These mechanisms of image dye formation are textbook knowledge, as illustrated by the Color Photography topic in *The Kirk-Othmer Encyclopedia of Chemical Technology,* John Wiley and Sons, New York, 1993; Vol. 6.

Since the molar ratio of image dye produced to developed silver is lower when a four equivalent image dye-forming coupler is employed than when a two equivalent image dye-forming coupler is employed and since the photographic speeds of color photographic elements are compared by measuring the exposure difference required to reach a reference image dye density, it is apparent that otherwise comparable color photographic elements containing two equivalent image dye-forming couplers exhibit higher imaging speeds than those that contain four equivalent image dye-forming couplers. This recognition led to investigation of one equivalent image dye-forming couplers. One equivalent image dye-forming couplers are similar to two equivalent image dye-forming couplers in that only one quinone-diimine molecule is required to form an image dye molecule. One equivalent couplers differ from two equivalent couplers in that the leaving group that is split off prior to coupling itself supplies a molecule of image dye which is in addition to the molecule of image dye produced by coupling. Hence, reduction of two molecules of silver halide to silver produces two molecules of oxidized para-phenylenediamine color developing, which produce one molecule of quinone-diimine that reacts with a one equivalent coupler to produce two image dye molecules. Hence, in theory (ignoring second order reaction inefficiencies) there is a one to one molar ratio of developed silver to image dye. The unique requirements imposed by dye chromophore containing leaving groups in one equivalent image dye-forming couplers have limited their application, with two and four equivalent structures forming the overwhelming majority of image dye-forming couplers. One equivalent image dye-forming couplers are described in Mooberry et al U.S. Pat. Nos. 4,840,884, 5,447,819 and 5,457,004.

In the last two decades enhancements in dye images attributable to the incorporation of dye image modifying couplers have become common. These couplers, which often do not form an image dye on coupling, can be relied upon for immediate or timed release of photographically useful fragments, such as development accelerators, development inhibitors, bleach accelerators, bleach inhibitors, developing agents (e.g., competing or auxiliary developing agents), silver complexing agents, fixing agents, toners, hardeners, tanning agents, antistain agents, stabilizers, antifoggants, competing couplers, and chemical or spectral sensitizers or desensitizers.

A summary of couplers is provided by *Research Disclosure,* Item 38957, cited above, X. Dye image formers and modifiers, particularly B. Image-dye-forming couplers and C. Image dye modifiers.

RELATED APPLICATIONS

Applicants' concurrently filed, commonly assigned patent application Ser. No. 09/213,739, titled PHOTOGRAPHIC EMULSIONS AND ELEMENTS OF INCREASED SENSITIVITY, (hereinafter referred to as Applicatinn T) is directed to a photographic emulsion comprised of (a) radiation-sensitive silver halide grains, (b) sensitizer for the silver halide grains, and (c) peptizer for the silver halide grains wherein (a) the radiation-sensitive silver halide grains include tabular grains (1) having {111} major faces, (2) containing greater than 50 mole percent bromide, based on silver, and (3) accounting for greater than 50 percent total grain projected area, (b) the sensitizer includes a fragmentable electron donating sensitizer, and (c) the peptizer is a water dispersible cationic starch.

Applicants' concurrently filed, commonly assigned patent application U.S. Ser. No. 09/213,639, titled COLOR PHOTOGRAPHIC ELEMENTS OF INCREASED SENSITIVITY, (hereinafter referred to as Application II) is directed to a photographic recording element comprised of a support and at least one dye image forming layer unit containing (a) radiation-sensitive silver halide grains, (b) sensitizer for the silver halide grains, (c) peptizer for the silver halide grains, (d) at least one dye image providing coupler, and (e) at least one dye image enhancing coupler, wherein (a) the radiation-sensitive silver halide grains include tabular grains (1) having {111} major faces, (2) containing greater than 50 mole percent bromide, based on silver, and (3) accounting for greater than 50 percent total grain projected area, (b) the sensitizer includes a fragmentable electron donating sensitizer, (c) the peptizer is a water dispersible cationic starch, (d) the dye image providing coupler is a coupler capable of reacting with oxidized primary amine color developing agent to form a dye image, and (e) the dye image enhancing coupler is comprised of a coupler capable of reacting with oxidized primary amine color developing agent to release an electron transfer agent.

SUMMARY OF THE INVENTION

A photographic recording element comprised of a support and at least one dye image forming layer unit containing (a) radiation-sensitive silver halide grains, (b) sensitizer for the silver halide grains, (c) peptizer for the silver halide grains, and (d) at least one dye image providing coupler, wherein (a) the radiation-sensitive silver halide grains include tabular grains (1) having {111} major faces, (2) containing greater than 50 mole percent bromide, based on silver, and (3) accounting for greater than 50 percent total grain projected area, (b) the sensitizer includes a fragmentable electron donating sensitizer, (c) the peptizer is a water dispersible cationic starch, and (d) the dye image providing coupler is a one equivalent image dye-forming coupler.

In comparing high bromide {111} tabular grain emulsions precipitated in the presence of a cationic starch peptizer and sensitized with a fragmentable electron donating (FED) sensitizer with an otherwise similar emulsion that contains a gelatino-peptizer, the starch peptized emulsions have been observed to exhibit significantly higher speeds than the gelatin peptized emulsions. When the comparisons are repeated, but with the FED sensitizer removed, a relatively small speed advantage is observed for the starch peptized emulsions. The large speed advantage realized by FED sensitizer addition to starch peptized high bromide {111} tabular grain emulsions was entirely unexpected. This speed advantage is reported in this application and in Applications I and II, cited above.

In addition, the photographic elements of this invention exhibit a further increase in imaging speed attributable to the incorporation of one equivalent image-dye forming coupler. If the image dye supplied by the leaving group of a one equivalent coupler is as light absorptive as the dye chromophore formed by coupling, the one equivalent coupler produces an image dye density twice that produced by the same molar coating coverage of a two equivalent coupler and four times that produced by the same molar coating coverage of four equivalent coupler. However, even larger increases in image dye density are possible based on comparable molar coating coverages, since the leaving group can be formed to contain dye chromophores that are much more light absorptive than the dyes formed by the coupling reaction. Stated another way, the larger degree of structural freedom imparted by incorporating a dye chromophore in a leaving group as opposed to forming a dye chromophore by reacting a quinonediimine with a coupler allows leaving group dye chromophores to be selected that can account for the majority of dye image light absorption. If it is desired to merely equal the imaging speeds realizable with two equivalent image dye-forming couplers, then the molar coating coverages of the one equivalent image dye-forming couplers can be reduced well below half the molar coating coverages required to form a dye image using a comparable two equivalent image dye-forming coupler.

DETAILED DESCRIPTION OF THE INVENTION

The present invention is generally applicable to color photographic elements that contain in at least one dye image forming layer unit a fragmentable electron donor (FED) sensitized, cationic starch peptized high bromide {111} tabular grain emulsion, and a one equivalent image dye-forming coupler. High bromide {111} tabular grain emulsions are those in which greater than 50 percent of total grain projected area is accounted for by tabular grains having {111} major faces and containing greater than 50 mole percent bromide, based on silver.

Any conventional water dispersible cationic starch can be employed as a peptizer. The term "starch" is employed to include both natural starch and modified derivatives, such as dextrinated, hydrolyzed, alkylated, hydroxyalkylated, acetylated or fractionated starch. The starch can be of any origin, such as corn starch, wheat starch, potato starch, tapioca starch, sago starch, rice starch, waxy corn starch or high amylose corn starch.

Starches are generally comprised of two structurally distinctive polysaccharides, (α-amylose and amylopectin. Both are comprised of (α-D-gluco-pyranose units. In α-amylose the (α-D-glucopyranose units form a 1,4-straight chain polymer. The repeating units take the following form:

(I)

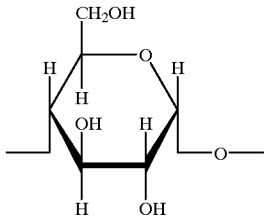

In amylopectin, in addition to the 1,4-bonding of repeating units, 6-position chain branching (at the site of the —$CH_2OH$ group above) is also in evidence, resulting in a branched chain polymer. The repeating units of starch and cellulose are diasteroisomers that impart different overall geometries to the molecules. The α anomer, found in starch and shown in formula I above, results in a polymer that is capable of crystallization and some degree of hydrogen bonding between repeating units in adjacent molecules, but not to the same degree as the β anomer repeating units of cellulose and cellulose derivatives. Polymer molecules formed by the β anomers show strong hydrogen bonding between adjacent molecules, resulting in clumps of polymer molecules and a much higher propensity for crystallization. Lacking the alignment of substituents that favors strong intermolecular bonding, found in cellulose repeating units, starch and starch derivatives are much more readily dispersed in water.

The water dispersible starches employed in the practice of the invention are cationic—that is, they contain an overall net positive charge when dispersed in water. Starches are conventionally rendered cationic by attaching a cationic substituent to the (α-D-glucopyranose units, usually by esterification or etherification at one or more free hydroxyl sites. Reactive cationogenic reagents typically include a primary, secondary or tertiary amino group (which can be subsequently protonated to a cationic form under the intended conditions of use) or a quaternary ammonium, sulfonium or phosphonium group.

To be useful as a peptizer the cationic starch must be water dispersible. Many starches disperse in water upon heating to temperatures up to boiling for a short time (e.g., 5 to 30 minutes). High sheer mixing also facilitates starch dispersion. The presence of cationic substituents increases the polar character of the starch molecule and facilitates dispersion. The starch molecules preferably achieve at least a colloidal level of dispersion and ideally are dispersed at a molecular level—i.e., dissolved.

The following teachings, the disclosures of which are here incorporated by reference, illustrate water dispersible cationic starches within the contemplation of the invention:

*Rutenberg et al U.S. Pat. No. 2,989,520;
Meisel U.S. Pat. No. 3,017,294;
Elizer et al U.S. Pat. No. 3,051,700;
Aszolos U.S. Pat. No. 3,077,469;
Elizer et al U.S. Pat. No. 3,136,646;
*Barber et al U.S. Pat. No. 3,219,518;
*Mazzarella et al U.S. Pat. No. 3,320,080;
Black et al U.S. Pat. No. 3,320,118;
Caesar U.S. Pat. No. 3,243,426;
Kirby U.S. Pat. No. 3,336,292;
Jarowenko U.S. Pat. No. 3,354,034;
Caesar U.S. Pat. No. 3,422,087;
*Dishburger et al U.S. Pat. No. 3,467,608;
*Beaninga et al U.S. Pat. No. 3,467,647;
Brown et al U.S. Pat. No. 3,671,310;
Cescato U.S. Pat. No. 3,706,584;
Jarowenko et al U.S. Pat. No. 3,737,370;
*Jarowenko U.S. Pat. No. 3,770,472;
Moser et al U.S. Pat. No. 3,842,005;
Tessler U.S. Pat. No. 4,060,683;
Rankin et al U.S. Pat. No. 4,127,563;
Huchette et al U.S. Pat. No. 4,613,407;
Blixt et al U.S. Pat. No. 4,964,915;
*Tsai et al U.S. Pat. No. 5,227,481; and
*Tsai et al U.S. Pat. No. 5,349,089.

It is preferred to employ an oxidized cationic starch. The starch can be oxidized before (* patents above) or following the addition of cationic substituents. This is accomplished by treating the starch with a strong oxidizing agent. Both hypochlorite ($ClO^-$) or periodate ($IO_4^-$) have been extensively used and investigated in the preparation of commercial starch derivatives and preferred. While any convenient oxidizing agent counter ion can be employed, preferred counter ions are those fully compatible with silver halide emulsion preparation, such as alkali and alkaline earth cations, most commonly sodium, potassium or calcium.

When the oxidizing agent opens the α-D-glucopyranose ring, the oxidation sites are usually at the 2 and 3 position carbon atoms forming the (α-D-glucopyranose ring. The 2 and 3 position

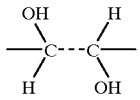

groups are commonly referred to as the glycol groups. The carbon-to-carbon bond between the glycol groups is replaced in the following manner:

(II)

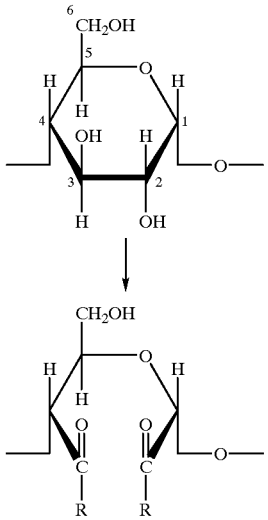

where R represents the atoms completing an aldehyde group or a carboxyl group.

The hypochlorite oxidation of starch is most extensively employed in commercial use. The hypochlorite is used in small quantities to modify impurities in starch. Any modification of the starch at these low levels is minimal, at most affecting only the polymer chain terminating aldehyde groups, rather than the (α-D-glucopyranose repeating units themselves. At levels of oxidation that affect the α-D-glucopyranose repeating units the hypochlorite affects the 2, 3 and 6 positions, forming aldehyde groups at lower levels of oxidation and carboxyl groups at higher levels of oxidation. Oxidation is conducted at mildly acidic and alkaline pH (e.g.,>5 to 11). The oxidation reaction is exothermic, requiring cooling of the reaction mixture. Temperatures of less than 45° C. are preferably maintained. Using a hypobromite oxidizing agent is known to produce similar results as hypochlorite.

Hypochlorite oxidation is catalyzed by the presence of bromide ions. Since silver halide emulsions are conventionally precipitated in the presence of a stoichiometric excess of the halide to avoid inadvertent silver ion reduction (fogging), it is conventional practice to have bromide ions in the dispersing media of high bromide silver halide emulsions. Thus, it is specifically contemplated to add bromide ion to the starch prior to performing the oxidation step in the concentrations known to be useful in the high bromide {111} tabular grain emulsions—e.g., up to a pBr of 3.0.

Cescato U.S. Pat. No. 3,706,584, the disclosure of which is here incorporated by reference, discloses techniques for the hypochlorite oxidation of cationic starch. Sodium bromite, sodium chlorite and calcium hypochlorite are named as alternatives to sodium hypochlorite. Further teachings of the hypochlorite oxidation of starches is provided by the following: R. L. Whistler, E. G. Linke and S. Kazeniac, "Action of Alkaline Hypochlorite on Corn Starch Amylose and Methyl 4-O-Methyl-D-glucopyranosides", *Journal Amer. Chem. Soc.,* Vol. 78, pp. 4704–9 (1956); R. L. Whistler and R. Schweiger, "Oxidation of Amylopectin with Hypochlorite at Different Hydrogen Ion Concentrations, *Journal Amer. Chem. Soc.,* Vol. 79, pp. 6460–6464 (1957); S. Schmorak, D. Mejzler and M. Lewin, "A Kinetic Study of the Mild Oxidation of Wheat Starch by Sodium Hypochloride in the Alkaline pH Range", *Journal of Polymer Science,* Vol. XLIX, pp. 203–216 (1961); J. Schmorak and M. Lewin, "The Chemical and Physico-chemical Properties of Wheat Starch with Alkaline Sodium Hypochlorite", *Journal of Polymer Science: Part A,* Vol. 1, pp. 2601–2620 (1963); K. F. Patel, H. U. Mehta and H. C. Srivastava, "Kinetics and Mechanism of Oxidation of Starch with Sodium Hypochlorite", *Journal of Applied Polymer Science,* Vol. 18, pp. 389–399 (1974); R. L. Whistler, J. N. Bemiller and E. F. Paschall, *Starch: Chemistry and Technology,* Chapter X, Starch Derivatives: Production and Uses, II. Hypochlorite-Oxidized Starches, pp. 315–323, Academic Press, 1984; and O. B. Wurzburg, *Modified Starches: Properties and Uses,* III. Oxidized or Hypochlorite-Modified Starches, pp. 23–28 and pp. 245–246, CRC Press (1986). Although hypochlorite oxidation is normally carried out using a soluble salt, the free acid can alternatively be employed, as illustrated by M. E. McKillican and C. B. Purves, "Estimation of Carboxyl, Aldehyde and Ketone Groups in Hypochlorous Acid Oxystarches", *Can. J. Chem.,* Vol.312–321 (1954).

Periodate oxidizing agents are of particular interest, since they are known to be highly selective. The periodate oxidizing agents produce starch dialdehydes by the reaction shown in the formula (II) above without significant oxidation at the site of the 6 position carbon atom. Unlike hypochlorite oxidation, periodate oxidation does not produce carboxyl groups and does not produce oxidation at the 6 position. Mehltretter U.S. Pat. No. 3,251,826, the disclosure of which is here incorporated by reference, discloses the use of periodic acid to produce a starch dialdehyde which is subsequently modified to a cationic form. Mehltretter also discloses for use as oxidizing agents the soluble salts of periodic acid and chlorine. Further teachings of the periodate oxidation of starches is provided by the following: V. C. Barry and P. W. D. Mitchell, "Properties of Periodate-oxidized Polysaccharides. Part II. The Structure of some Nitrogen-containing Polymers", *Journal Amer. Chem. Soc.,* 1953, pp.3631–3635; P. J. Borchert and J. Mirza, "Cationic Dispersions of Dialdehyde Starch I. Theory and Preparation", *Tappi,* Vol. 47, No. 9, pp. 525–528 (1964); J. E. McCormick, "Properties of Periodate-oxidized Polysaccharides. Part VII. The Structure of Nitrogen-containing Derivatives as deduced from a Study of Monosaccharide Analogues", *Journal Amer. Chem. Soc.,* pp. 2121–2127 (1966); and O. B. Wurzburg, *Modified Starches: Properties and Uses,* III. Oxidized or Hypochlorite-Modified Starches, pp.28–29, CRC Press (1986).

Starch oxidation by electrolysis is disclosed by F. F. Farley and R. M. Hixon, "Oxidation of Raw Starch Granules by Electrolysis in Alkaline Sodium Chloride Solution", *Ind. Eng. Chem.,* Vol. 34, pp. 677–681 (1942).

Depending upon the choice of oxidizing agents employed, one or more soluble salts may be released during the oxidation step. Where the soluble salts correspond to or are similar to those conventionally present during silver halide precipitation, the soluble salts need not be separated from the oxidized starch prior to silver halide precipitation. It is, of course, possible to separate soluble salts from the oxidized cationic starch prior to precipitation using any conventional separation technique. For example, removal of halide ion in excess of that desired to be present during grain precipitation can be undertaken. Simply decanting solute and dissolved salts from oxidized cationic starch particles is a simple alternative. Washing under conditions that do not solubilize the oxidized cationic starch is another preferred option. Even if the oxidized cationic starch is dispersed in a solute during oxidation, it can be separated using conventional ultrafiltration techniques, since there is a large molecular size separation between the oxidized cationic starch and soluble salt by-products of oxidation.

The carboxyl groups formed by oxidation take the form —C(O)OH, but, if desired, the carboxyl groups can, by further treatment, take the form —C(O)OR', where R' represents the atoms forming a salt or ester. Any organic moiety added by esterification preferably contains from 1 to 6 carbon atoms and optimally from 1 to 3 carbon atoms.

The minimum degree of oxidation contemplated is that required to reduce the viscosity of the starch. It is generally accepted (see citations above) that opening an (α-D-glucopyranose ring in a starch molecule disrupts the helical configuration of the linear chain of repeating units which in turn reduces viscosity in solution. It is contemplated that at least one (α-D-glucopyranose repeating unit per starch polymer, on average, be ring opened in the oxidation process. As few as two or three opened (α-D-glucopyranose rings per polymer has a profound effect on the ability of the starch polymer to maintain a linear helical configuration. It is generally preferred that at least 1 percent of the glucopyranose rings be opened by oxidation.

A preferred objective is to reduce the viscosity of the cationic starch by oxidation to less than four times (400 percent of) the viscosity of water at the starch concentrations employed in silver halide precipitation. Although this viscosity reduction objective can be achieved with much lower levels of oxidation, starch oxidations of up to 90 percent of the α-D-glucopyranose repeating units have been reported (Wurzburg, cited above, p. 29). A typical convenient range of oxidation ring-opens from 3 to 50 percent of the α-D-glucopyranose rings.

The water dispersible cationic starch is present during the precipitation (during nucleation and grain growth or during grain growth) of the high bromide {111} tabular grains. Preferably precipitation is conducted by substituting the water dispersible cationic starch for all conventional gelatino-peptizers. In substituting the selected cationic starch peptizer for conventional gelatino-peptizers, the concentrations of the selected peptizer and the point or points of addition can correspond to those employed using gelatino-peptizers.

In addition, it has been unexpectedly discovered that emulsion precipitation can tolerate even higher concentrations of the selected peptizer. For example, it has been observed that all of the selected peptizer required for the preparation of an emulsion through the step of chemical sensitization can be present in the reaction vessel prior to grain nucleation. This has the advantage that no peptizer additions need be interjected after tabular grain precipitation has commenced. It is generally preferred that from 1 to 500 grams (most preferably from 5 to 100 grams) of the selected peptizer per mole of silver to be precipitated be present in the reaction vessel prior to tabular grain nucleation.

At the other extreme, it is, of course, well known, as illustrated by Mignot U.S. Pat. No. 4,334,012, here incorporated by reference, that no peptizer is required to be present during grain nucleation, and, if desired, addition of the selected peptizer can be deferred until grain growth has progressed to the point that peptizer is actually required to avoid tabular grain agglomeration.

The procedures for high bromide {111} tabular grain emulsion preparation through the completion of tabular grain growth require only the substitution of the selected peptizer for conventional gelatino-peptizers. The following high bromide {111} tabular grain emulsion precipitation procedures, here incorporated by reference, are specifically contemplated to be useful in the practice of the invention, subject to the selected peptizer modifications discussed above:

Daubendiek et al U.S. Pat. No. 4,414,310;
Abbott et al U.S. Pat. No. 4,425,426;
Wilgus et al U.S. Pat. No. 4,434,226;
Maskasky U.S. Pat. No. 4,435,501;
Kofron et al U.S. Pat. No. 4,439,520;
Solberg et al U.S. Pat. No. 4,433,048;
Evans et al U.S. Pat. No. 4,504,570;
Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitou et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Antoniades et al U.S. Pat. No. 5,250,403;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Chaffee et al U.S. Pat. No. 5,358,840; and
Delton U.S. Pat. No. 5,372,927.

The high bromide {111} tabular grain emulsions that are formed preferably contain at least 70 (optimally at least 90) mole percent bromide, based on silver. Silver bromide, silver iodobromide, silver chlorobromide, silver iodochlorobromide, and silver chloroiodobromide tabular grain emulsions are specifically contemplated. Although silver chloride and silver bromide form tabular grains in all proportions, chloride is preferably present in concentrations of 30 mole percent, based on silver, or less. Iodide can be present in the tabular grains up to its solubility limit under the conditions selected for tabular grain precipitation. Under ordinary conditions of precipitation silver iodide can be incorporated into the tabular grains in concentrations ranging up to about 40 mole percent, based on silver. It is generally preferred that the iodide concentration be less than 20 mole percent, based on silver. Typically the iodide concentration is less than 10 mole percent, based on silver. To facilitate rapid processing, such as commonly practiced in radiography, it is preferred that the iodide concentration be limited to less than 4 mole percent, based on silver. Significant photographic advantages can be realized with iodide concentrations as low as 0.5 mole percent, based on silver, with an iodide concentration of at least 1 mole percent, based on silver, being preferred.

The high bromide {111} tabular grain emulsions can exhibit mean grain ECD's of any conventional value, ranging up to 10 $\mu$m, which is generally accepted as the maximum mean grain size compatible with photographic utility. In practice, the tabular grain emulsions of the invention typically exhibit a mean ECD in the range of from about 0.2 to 7.0 $\mu$m. Tabular grain thicknesses typically range from about 0.03 $\mu$m to 0.3 $\mu$m. For blue recording somewhat thicker grains, up to about 0.5 $\mu$m, can be employed. For minus blue (red and/or green) recording, thin (<0.2 $\mu$m) tabular grains are preferred.

The advantages that tabular grains impart to emulsions generally increases as the average aspect ratio or tabularity of the tabular grain emulsions increases. Both aspect ratio (ECD/t) and tabularity (ECD/$t^2$, where ECD and t are measured in $\mu$m) increase as average tabular grain thickness decreases. Therefore it is generally sought to minimize the thicknesses of the tabular grains to the extent possible for the photographic application. Absent specific application prohibitions, it is generally preferred that the tabular grains having a thickness of less than 0.3 $\mu$m (preferably less than 0.2 $\mu$m and optimally less than 0.07 $\mu$m) and accounting for greater than 50 percent (preferably at least 70 percent and optimally at least 90 percent) of total grain projected area exhibit an average aspect ratio of greater than 5 and most preferably greater than 8. Tabular grain average aspect ratios can range up to 100, 200 or higher, but are typically in the range of from about 12 to 80. Tabularities of>25 are generally preferred.

High bromide {111} tabular grain emulsions precipitated in the presence of a cationic starch are disclosed in the following patents, the disclosures of which are here incorporated by reference: Maskasky U.S. Pat. Nos. 5,604,085, 5,620,840, 5,667,955, 5,691,131, and 5,733,718.

Conventional dopants can be incorporated into the tabular grains during their precipitation, as illustrated by the patents cited above and *Research Disclosure,* Item 38957, cited above, Section I. Emulsion grains and their preparation, D. Grain modifying conditions and adjustments, paragraphs (3), (4) and (5). It is specifically contemplated to incorporate shallow electron trapping (SET) site providing dopants in the tabular grains, further disclosed in *Research Disclosure,* Vol. 367, November 1994, Item 36736, and Olm et al U.S. Pat. No. 5,576,171, here incorporated by reference.

It is also recognized that silver salts can be epitaxially grown onto the tabular grains during the precipitation process. Epitaxial deposition onto the edges and/or corners of tabular grains is specifically taught by Maskasky U.S. Pat. No. 4,435,501 and Daubendiek et al U.S. Pat. Nos. 5,573,902 and 5,576,168, here incorporated by reference.

Although epitaxy onto the host tabular grains can itself act as a sensitizer, the emulsions of the invention show sensitivity enhancements with or without epitaxy when chemically sensitized employing one or a combination of noble metal, middle chalcogen (sulfur, selenium and/or tellurium) and reduction chemical sensitization techniques. Conventional chemical sensitizations by these techniques are summarized in *Research Disclosure,* Item 38957, cited above, Section IV. Chemical sensitizations. It is preferred to employ at least one of noble metal (typically gold) and middle chalcogen (typically sulfur) and, most preferably, a combination of both in preparing the emulsions of the invention for photographic use. The use of a cationic starch peptizer allows distinct advantages relating to chemical sensitization to be realized. Under comparable levels of chemical sensitization higher photographic speeds can be realized using cationic starch peptizers. When comparable photographic speeds are sought, a cationic starch peptizer in the absence of gelatin allows lower levels of chemical sensitizers to be employed and results in better incubation keeping. When chemical sensitizer levels remain unchanged, speeds equal to those obtained using gelatino-peptizers can be achieved at lower precipitation and/or sensitization temperatures, thereby avoiding unwanted grain ripening.

Between emulsion precipitation and chemical sensitization, the step that is preferably completed before any gelatin or gelatin derivative is added to the emulsion, it is conventional practice to wash the emulsions to remove soluble reaction by-products (e.g., alkali and/or alkaline earth cations and nitrate anions). If desired, emulsion washing can be combined with emulsion precipitation, using ultrafiltration during precipitation as taught by Mignot U.S. Pat. No. 4,334,012. Alternatively emulsion washing by diafiltration after precipitation and before chemical sensitization can be undertaken with a semipermeable membrane as illustrated by *Research Disclosure,* Vol. 102, October 1972, Item 10208, Hagemaier et al *Research Disclosure,* Vol. 131, March 1975, Item 13122, Bonnet *Research Disclosure,* Vol. 135, July 1975, Item 13577, Berg et al German OLS 2,436,461 and Bolton U.S. Pat. No. 2,495,918, or by employing an ion-exchange resin, as illustrated by Maley U.S. Pat. No. 3,782,953 and Noble U.S. Pat. No. 2,827,428. In washing by these techniques there is no possibility of removing the selected peptizers, since ion removal is inherently limited to removing much lower molecular weight solute ions.

A specifically preferred approach to chemical sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetra-substituted middle chalcogen ureas of the type disclosed by Herz et al U.S. Pat. Nos. 4,749,646 and 4,810,626, the disclosures of which are here incorporated by reference. Preferred compounds include those represented by the formula:

(III)

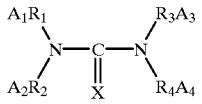

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetra substituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(IV)}$$

wherein

L is a mesoionic compound;

X is an anion; and $L^1$ is a Lewis acid donor.

In another preferred form of the invention it is contemplated to employ alone or in combination with sulfur sensitizers, such as those formula III, and/or gold sensitizers, such as those of formula IV, reduction sensitizers which are the 2-[N-(2-alkynyl)amino]-meta-chalcoazoles disclosed by Lok et al U.S. Pat. Nos. 4,378,426 and 4,451,557, the disclosures of which are here incorporated by reference.

Preferred 2-[N-(2-alkynyl)amino]-meta-chalcoazoles can be represented by the formula:

(V)

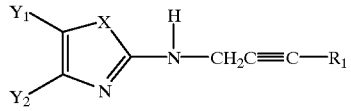

where

X=O, S, Se;

$R_1$=(Va) hydrogen or (Vb) alkyl or substituted alkyl or aryl or substituted aryl; and $Y_1$ and $Y_2$ individually represent hydrogen, alkyl groups or an aromatic nucleus or together represent the atoms necessary to complete an aromatic or alicyclic ring containing atoms selected from among carbon, oxygen, selenium, and nitrogen atoms.

The formula V compounds are generally effective (with the Vb form giving very large speed gains and exceptional latent image stability) when present during the heating step (finish) that results in chemical sensitization.

The fragmentable electron donating sensitizer provides additional speed when used in place of one, some or all conventional chemical sensitizers or in combination with these sensitizers. It is common practice in chemically sensitizing gelatio-peptized emulsions to hold the emulsions for a period of time at an elevated temperature to effect chemical sensitization. The FED sensitizer can be added before heating when the sensitizer is sufficiently stable to withstand the elevated temperature without fragmenting. However, where a heating step is contemplated to effect a conventional chemical sensitization, it is preferred to add the FED sensitizer at the conclusion of the heating step. One of the significant advantages of this invention is that the oxidized cationic starch peptized emulsions can be efficiently chemically sensitized with conventional sensitizers, such as those of formulae (III), (IV) and (V) above, at lower temperatures. For example, chemical sensitization can be achieved at temperatures lower than those required for the sensitization of corresponding gelatino-peptized emulsions. It is possible to achieve chemical sensitization of oxidized cationic starch peptized tabular grain emulsions by heating to temperatures of<40° C. Thus, the FED sensitizer can be added before, during or after addition of any other, conventional chemical sensitizers.

Fragmentable electron donating (FED) sensitizers of the types disclosed by Farid et al U.S. Pat. Nos. 5,747,235 and 5,7547,236; in Lenhard et al U.S. Ser. No. 08/739,911, filed Oct. 30, 1996; and in Gould et al U.S. Ser. No. 09/118,536, Farid et al U.S. Ser. No. 09/118,552, and Adin et al U.S. Ser. No. 09/118,714, each filed Jun. 25, 1998; the disclosures of which are here incorporated by reference, are specifically contemplated for use in the practice of this invention.

These FED sensitizers satisfy the formula X—Y', X—Y' forming the entire sensitizer or a moiety —X—Y' of the sensitizer, wherein X is an electron donating compound moiety;

Y' is a proton or a leaving group Y; and wherein:

(1) X—Y' has an oxidation potential between 0 and about 1.4 V; and (2) the oxidized form of X—Y' undergoes a bond cleavage reaction to give the radical $X^{\bullet}$ and the leaving fragment Y'; and, optionally, (3) the radical $X^{\bullet}$ has an oxidation potential≦−0.7 V (that is, equal to or more negative than about −0.7 V).

In embodiments of the invention wherein Y' is a proton, a base, $B^-$, is covalently linked directly or indirectly to X.

Compounds wherein X—Y' meets criteria (1) and (2) but not (3) are capable of donating one electron and are referred to herein as fragmentable one-electron donating compounds. Compounds which meet all three criteria are capable of donating two electrons and are referred to herein as fragmentable two-electron donating compounds.

In this patent application, oxidation potentials are reported as "V" which represents volts versus a saturated calomel reference electrode.

In embodiments of the invention in which Y' is Y, the following represents the reactions that are believed to take place when X—Y undergoes oxidation and fragmentation to produce a radical $X^{\bullet}$, which in a preferred embodiment undergoes further oxidation.

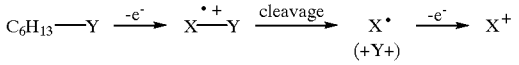

Electron elimination from compound X—Y occurs when the oxidation potential of X—Y is equal to or more negative than 1.4 volts. Electron elimination from the free radical $X^{\bullet}$ occurs when $X^{\bullet}$ exhibits an oxidation potential equal to or more negative than −0.7 volt.

The structural features of X—Y are defined by the characteristics of the two parts, namely the fragment X and the fragment Y. The structural features of the fragment X determine the oxidation potential of the X—Y molecule and that of the radical $X^{\bullet}$, whereas both the X and Y fragments affect the fragmentation rate of the oxidized molecule $X—Y^{\bullet+}$.

In embodiments of the invention in which Y' is H, the following represents the reactions believed to take place when the compound X—H undergoes oxidation and deprotonation to the base, $B^-$, to produce a radical $X^{\bullet}$, which in a preferred embodiment undergoes further oxidation.

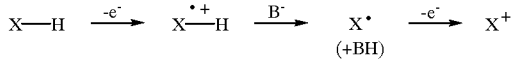

Preferred X groups are of the general formula:

(VI)

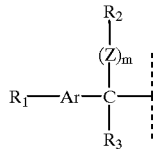

(VII)

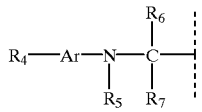

(VIII)

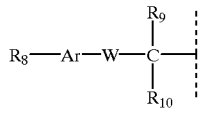

or (IX)

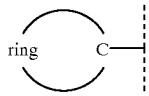

The symbol "R" (that is R without a subscript) is used in all structural formnulae in this patent application to represent a hydrogen atom or an unsubstituted or substituted alkyl group.

In structure (VI):

m=0, 1;

Z=O, S, Se, Te;

Ar=aryl group (e.g., phenyl, naphthyl, phenanthryl, anthryl); or heterocyclic group (e.g., pyridine, indole, benzimidazole, thiazole, benzothiazole, thiadiazole, etc.);

$R_1$=R, carboxyl, amide, sulfo-namide, halogen, $NR_2$, $(OH)_n$, $(OR')_n$, or $(SR)_n$;

R'=alkyl or substituted alkyl;

n=1-3;

$R_2$=R, Ar';

$R_3$=R, Ar';

$R_2$ and $R_3$ together can form 5- to 8-membered ring;

$R_2$ and Ar=can be linked to form 5- to 8-membered ring;

$R_3$ and Ar=can be linked to form 5- to 8-membered ring;

Ar'=aryl group such as phenyl, substituted phenyl, or heterocyclic group (e.g., pyridine, benzothiazole, etc.)

R=a hydrogen atom or an unsubstituted or substituted alkyl group.

In structure (VII):

Ar=aryl group (e.g., phenyl, naphthyl, phenanthryl); or heterocyclic group (e.g., pyridine, benzothiazole, etc.);

$R_4$=a substituent having a Hammett sigma value of −1 to +1, preferably −0.7 to +0.7, e.g., R, OR, SR, halogen, CHO, C(O)R, COOR, $CONR_2$, $SO_3R$, $SO_2NR_2$, $SO_2R$, SOR, C(S)R, etc;

$R_5$=R, Ar'

$R_6$ and $R_7$=R, Ar'

$R_5$ and Ar=can be linked to form 5- to 8-membered ring;

$R_6$ and Ar=can be linked to form 5- to 8-membered ring (in which case, $R_6$ can be a hetero atom);

$R_5$ and $R_6$ can be linked to form 5- to 8-membered ring;

$R_6$ and $R_7$ can be linked to form 5- to 8-membered ring;

Ar'=aryl group such as phenyl, substituted phenyl, heterocyclic group;

R=hydrogen atom or an unsubstituted or substituted alkyl group. A discussion on Hammett sigma values can be found in C. Hansch and R. W. Taft *Chem. Rev.* Vol 91, (1991) p 165, the disclosure of which is incorporated herein by reference.

In structure (VIII):

W=O, S, Se;

Ar=aryl group (e.g., phenyl, naphthyl, phenanthryl, anthryl); or heterocyclic group (e.g., indole, benzimidazole, etc.)

$R_8$=R, carboxyl, $NR_2$, $(OR)_n$, or $(SR)_n$ (n=1-3);

$R_9$ and $R_{10}$=R, Ar';

$R_9$ and Ar=can be linked to form 5- to 8-membered ring;

Ar'=aryl group such as phenyl substituted phenyl or heterocyclic group;

R=a hydrogen atom or an unsubstituted or substituted alkyl group.

In structure (IX):

"ring" represents a substituted or unsubstituted 5-, 6- or 7-membered unsaturated ring, preferably a heterocyclic ring.

The following are illustrative examples of the group X of the general structure VI:

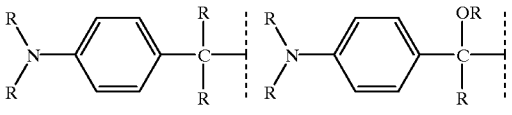

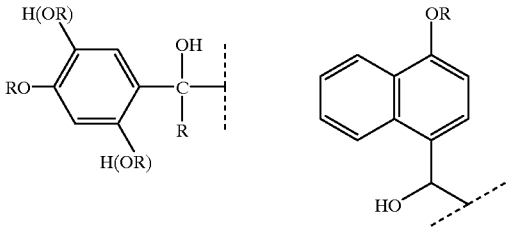

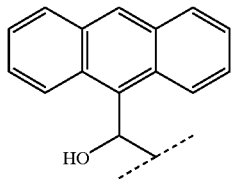

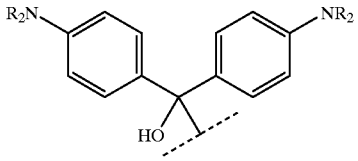

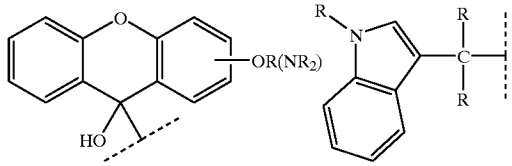

-continued

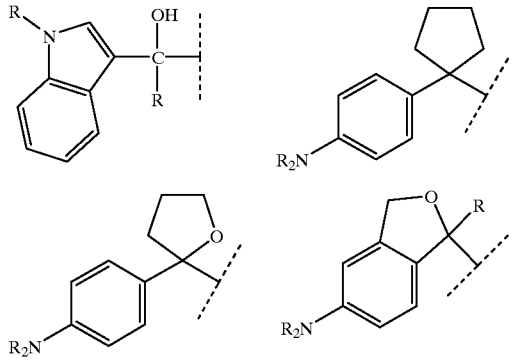

In the structures of this patent application a designation such as —OR($NR_2$) indicates that either —OR or —$NR_2$ can be present.

The following are illustrative examples of the group X of general structure VII:

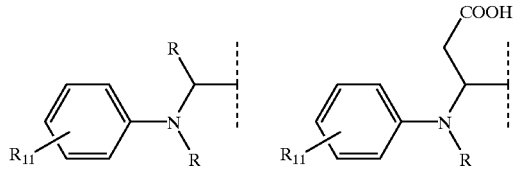

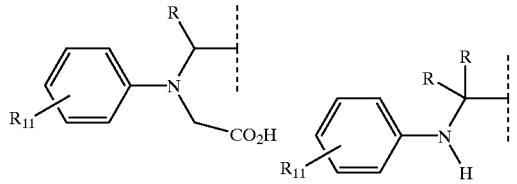

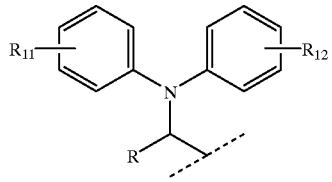

$R_{11}$ and $R_{12}$ = { H, alkyl, alkoxy, alkylthio, halo, carbamoyl; carboxyl, amido, formyl, sulfonyl, sulfonamido, nitrile }

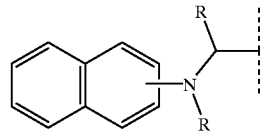

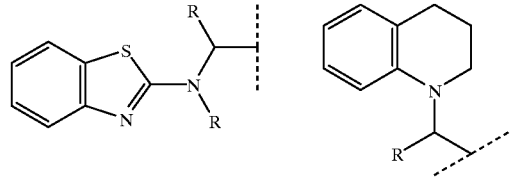

-continued

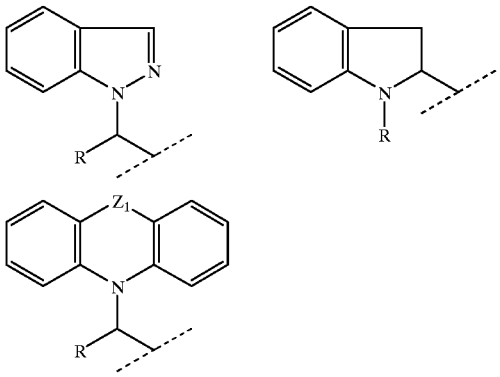

$Z_1$=a covalent bond, S, O, Se, NR, $CR_2$, CR═CR, or $CH_2CH_2$.

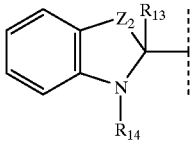

$Z_2$=S, O, Se, NR, $CR_2$, CR═CR, $R_{13}$,=alkyl, substituted alkyl or aryl, and $R_{14}$=H, alkyl substituted alkyl or aryl.

The following are illustrative examples of the group X of the general structure VIII:

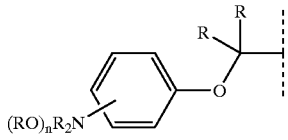

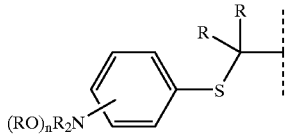

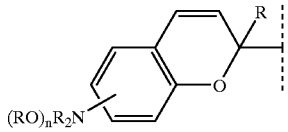

n = 1–3

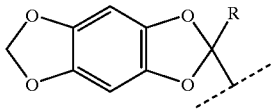

The following are illustrative examples of the group X of the general structure IX:

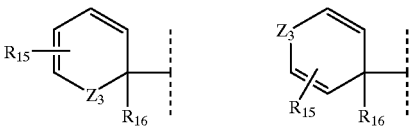

-continued

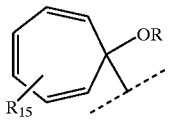

$Z_3$=O, S, Se, NR $R_{15}$=R, OR, $NR_2$ $R_{16}$=alkyl, substituted alkyl

Preferred Y' groups are:

(1) X', where X' is an X group as defined in structures VI-IX and may be the same as or different from the X group to which it is attached (2)

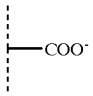

(3)

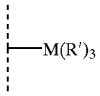

where M=Si, Sn or Ge; and R'=alkyl or substituted alkyl (4)

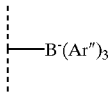

where Ar"=aryl or substituted aryl (5)

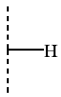

In preferred embodiments of this invention Y' is —H, —$COO^-$ or —$Si(R')_3$ or —X'. Particularly preferred Y' groups are —H, —$COO^-$ or —$Si(R')_3$. In embodiments of the invention in which Y' is a proton, a base, $B^-$, is covalently linked directly or indirectly to X. The base is preferably the conjugate base of an acid of pKa between about 1 and about 8, preferably about 2 to about 7. Collections of pKa values are available (see, for example: *Dissociation Constants of Organic Bases in Aqueous Solution,* D. D. Peril (Butterworths, London, 1965); *CRC Handbook of Chemistry and Physics,* 77th ed, D. R. Lide (CRC Press, Boca Raton, Fla., 1996)). Examples of useful bases are included in Table I.

TABLE I

| pKa's in water of the conjugate acids of some useful bases | |
|---|---|
| $CH_3$—$CO_2^-$ | 4.76 |
| $C_2H_5$—$CO_2^-$ | 4.87 |
| $(CH_3)_2CH$—$CO_2^-$ | 4.84 |
| $(CH_3)_3C$—$CO_2^-$ | 5.03 |

TABLE I-continued

| pKa's in water of the conjugate acids of some useful bases | |
|---|---|
| $HO—CH_2—CO_2^-$ | 3.83 |
| 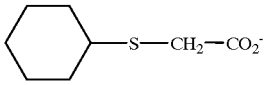 | 3.48 |
| $CH_3—CO—NH—CH_2—CO_2^-$ | 3.67 |
| 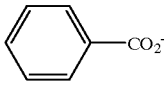 | 4.19 |
| 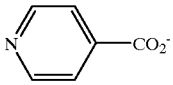 | 4.96 |
| $CH_3—COS^-$ | 3.33 |
| 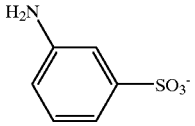 | 3.73 |
| 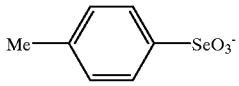 | 4.88 |
| 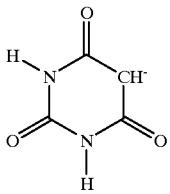 | 4.01 |
| 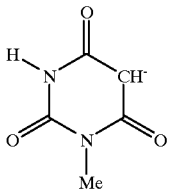 | 4.7 |
| $(CH_3)_3\overset{+}{N}—\overset{-}{O}$ | 4.65 |
| $H_2N—CH_2—CH(CH_3)—\overset{+}{N}H_3$ | 6.61 |
| 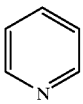 | 5.25 |
| 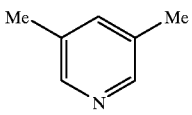 | 6.15 |

TABLE I-continued

| pKa's in water of the conjugate acids of some useful bases | |
|---|---|
| 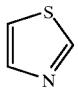 | 2.44 |
| 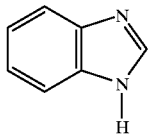 | 5.53 |

Preferably the base, $B^-$ is a carboxylate, sulfate or amine oxide.

In some embodiments of the invention, the fragmentable electron donating sensitizer contains a light absorbing group, Z, which is attached directly or indirectly to X, a silver halide absorptive group, A, directly or indirectly attached to X, or a chromophore forming group, Q, which is attached to X. Such fragmentable electron donating sensitizers are preferably of the following formulae:

$Z\text{-}(L\text{-}X\text{-}Y')_k$ $A\text{-}(L\text{-}X\text{-}Y')_k$ $(A\text{-}L)_k\text{-}X\text{-}Y'$ $Q\text{-}X\text{-}Y'$ $A\text{-}(X\text{-}Y')_k$ $(A)_k\text{-}X\text{-}Y'$ $Z\text{-}(X\text{-}Y')_k$ or $(Z)_k\text{-}X\text{-}Y'$ Z is a light absorbing group;

k is 1 or 2;

A is a silver halide adsorptive group that contains at least one atom of N, S, P, Se, or Te that promotes adsorption to silver halide;

L represents a linking group containing at least one C, N, S, P or O atom; and

Q represents the atoms necessary to form a chromophore comprising an amidinium-ion, a carboxyl-ion or dipolar-amidic chromophoric system when conjugated with X-Y'.

Z is a light absorbing group including, for example, cyanine dyes, complex cyanine dyes, merocyanine dyes, complex merocyanine dyes, homopolar cyanine dyes, styryl dyes, oxonol dyes, hemioxonol dyes, and hemicyanine dyes.

Preferred Z groups are derived from the following dyes:

Dye 1
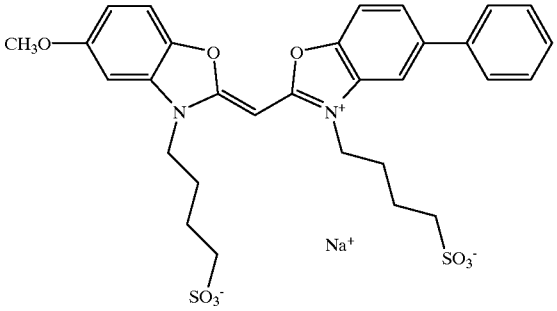
Dye 2
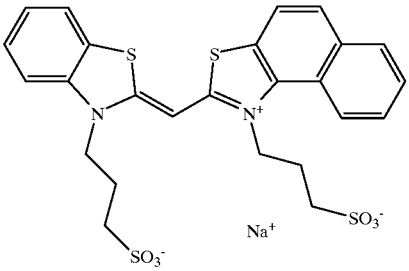
Dye 3
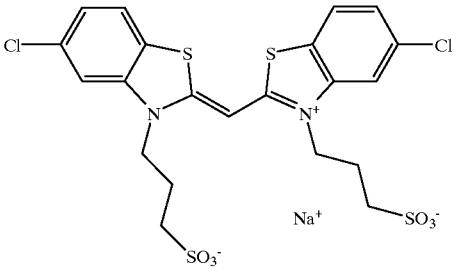
Dye 4
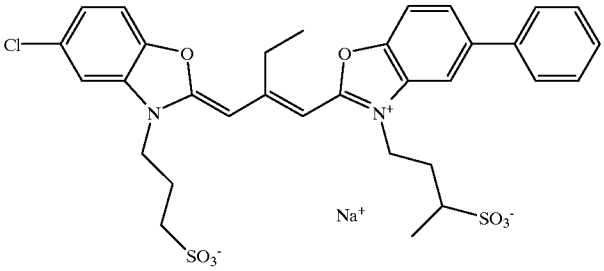
Dye 5
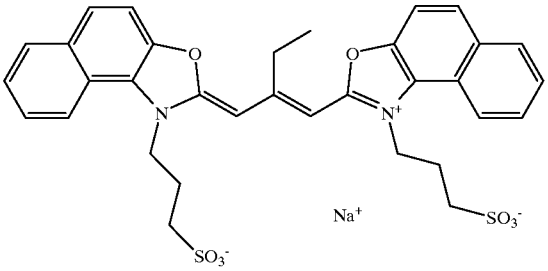

-continued

Dye 6

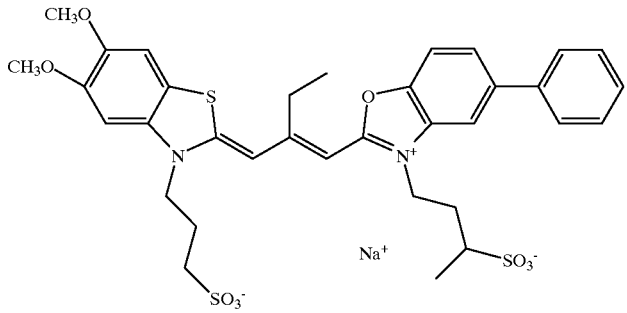

Dye 7

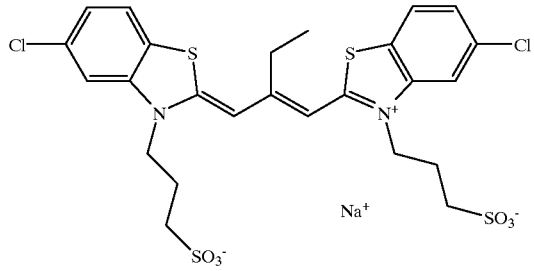

and

Dye 8

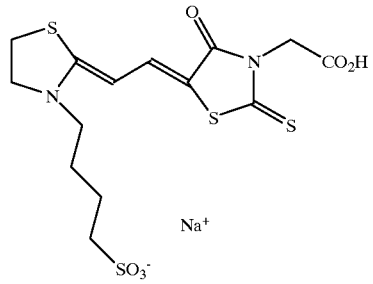

The linking group L may be attached to the dye at one (or more) of the heteroatoms, at one (or more) of the aromatic or heterocyclic rings, or at one (or more) of the atoms of the polymethine chain, at one (or more) of the heteroatoms, at one (or more) of the aromatic or heterocyclic rings, or at one (or more) of the atoms of the polymethine chain. For simplicity, and because of the multiple possible attachment sites, the attachment of the L group is not specifically indicated in the generic structures.

The silver halide adsorptive group A is preferably a silver-ion ligand moiety or a cationic surfactant moiety. In preferred embodiments, A is selected from the group consisting of: i) sulfur acids and their Se and Te analogs, ii) nitrogen acids, iii) thioethers and their Se and Te analogs, iv) phosphines, v) thionamides, selenamides, and telluramides, and vi) carbon acids.

Illustrative A groups include:

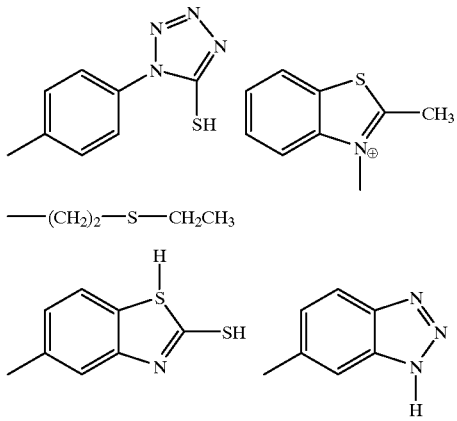

-continued

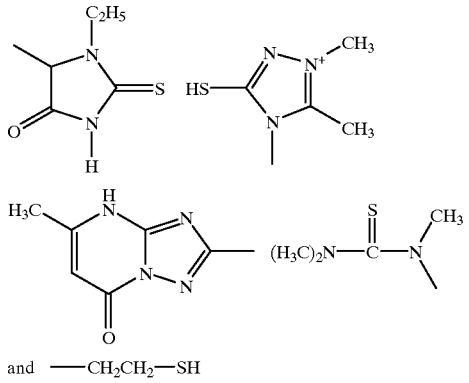

The point of attachment of the linking group L to the silver halide adsorptive group A will vary depending on the structure of the adsorptive group, and may be at one (or more) of the hetero atoms, at one (or more) of the aromatic or heterocyclic rings.

The linkage group represented by L which connects the light absorbing group to the fragmentable electron donating group XY by a covalent bond is preferably an organic linking group containing a least one C, N, S, or O atom. It is also desired that the linking group not be completely aromatic or unsaturated, so that a pi-conjugation system cannot exist between the Z and XY moieties. Preferred examples of the linkage group include, an alkylene group, an arylene group, —O—, —S—, —C═O, —$SO_2$—, —NH—, —P═O, and —N═. Each of these linking components can be optionally substituted and can be used alone or in combination. Examples of preferred combinations of these groups are:

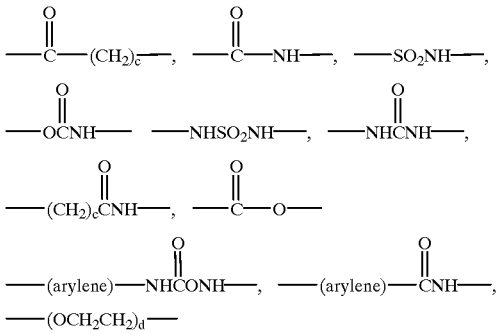

where c=1-30, and d=1-10

The length of the linkage group can be limited to a single atom or can be much longer, for instance up to 30 atoms in length. A preferred length is from about 2 to 20 atoms, and most preferred is 3 to 10 atoms. Some preferred examples of L can be represented by the general formulae indicated below:

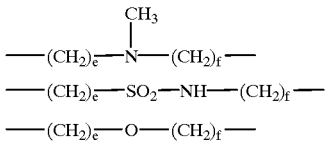

-continued

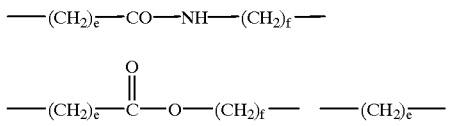

e and f=1-30, with the proviso that e+f≦30

Q represents the atoms necessary to form a chromophore comprising an arnidinium-ion, a carboxyl-ion or dipolar-amidic chromophoric system when conjugated with X-Y'. Preferably the chromophoric system is of the type generally found in cyanine, complex cyanine, hemicyanine, merocyanine, and complex merocyanine dyes as described in F. M. Hamer, *The Cyanine Dyes and Related Compounds* (Interscience Publishers, New York, 1964).

Illustrative Q groups include:

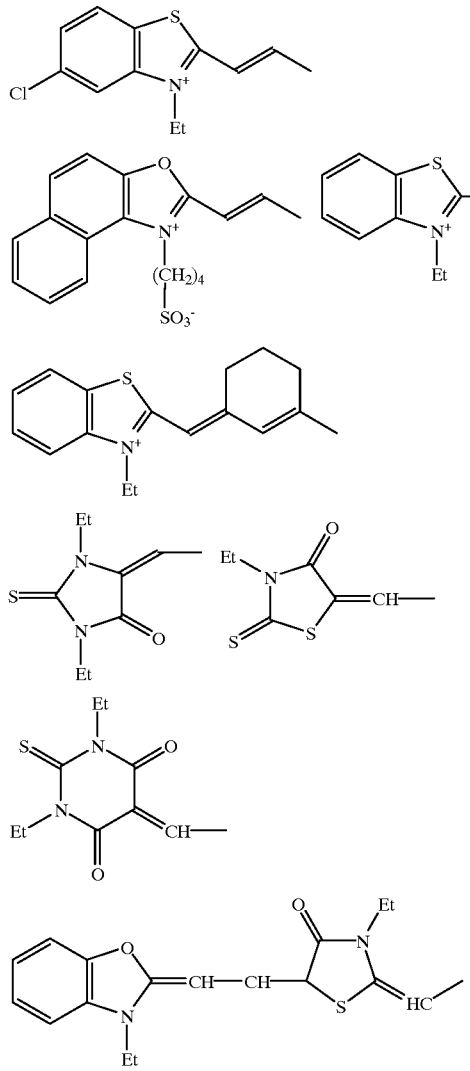

Particularly preferred are Q groups of the formula:

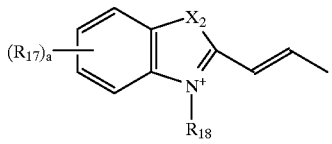

wherein:

$X_2$ is O, S, N, or $C(R_{19})_2$, where $R_{19}$ is substituted or unsubstituted alkyl.

each $R_{17}$ is independently a hydrogen atom, a halogen atom, a substituted or unsubstituted alkyl group, or substituted or unsubstituted aryl group;

a is an integer of 1–4; and $R_{18}$ is substituted or unsubstituted alkyl, or substituted or unsubstituted aryl.

Illustrative fragmentable electron donating sensitizers include:

FED 1

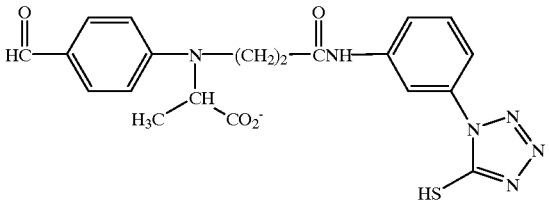

FED 2

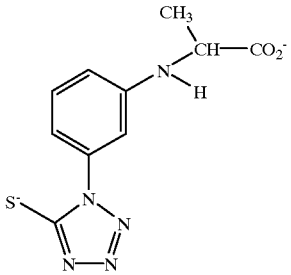

FED 3

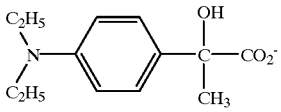

FED 4

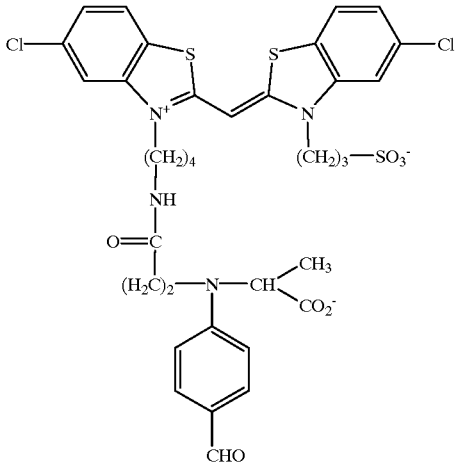

FED 5

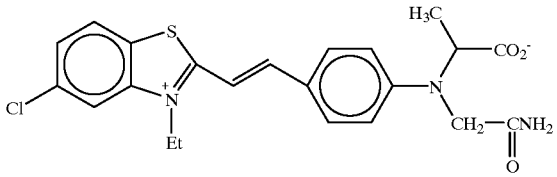

-continued
FED 6
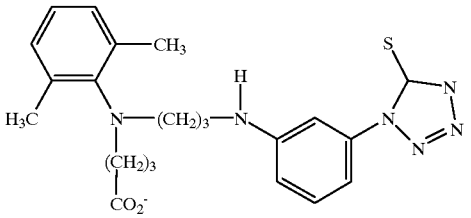
FED 7
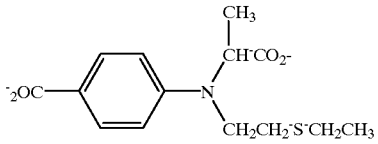
FED 8
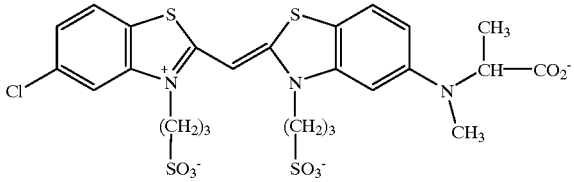
FED 9
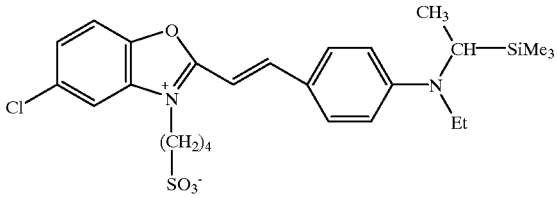
FED 10
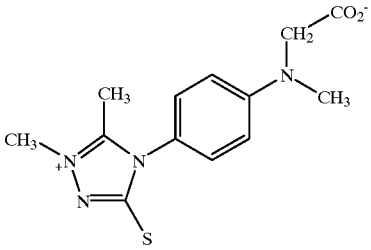
FED 11
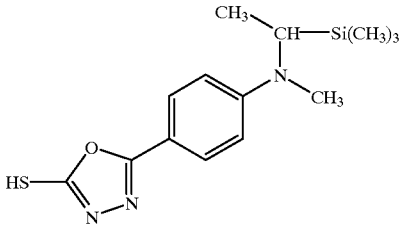
FED 12
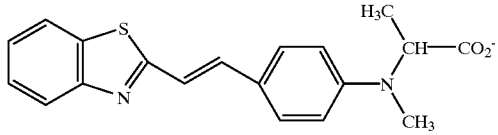
FED 13
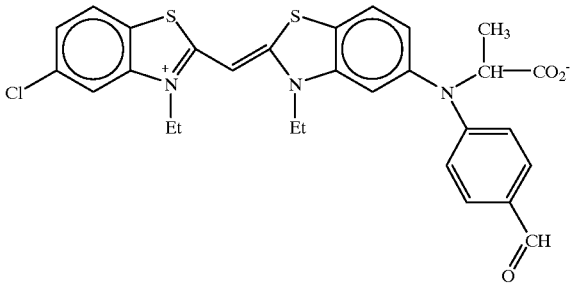
FED 14
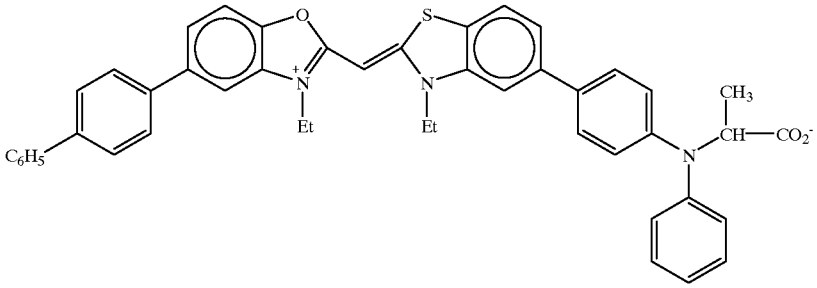

-continued
FED 15
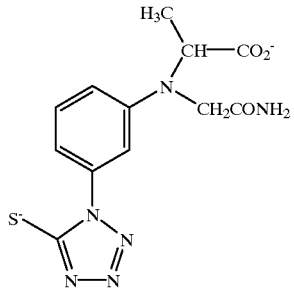
FED 16
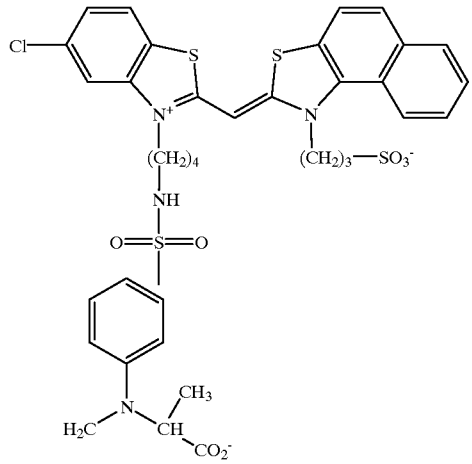
FED 17
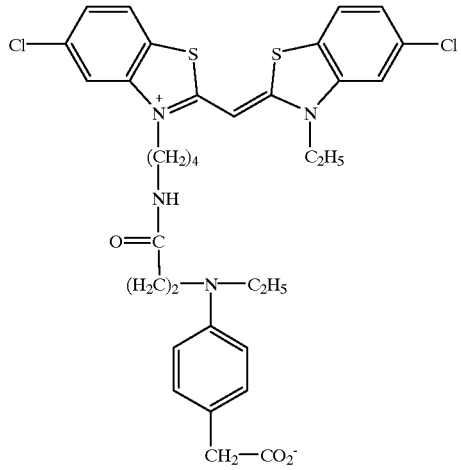
FED 18
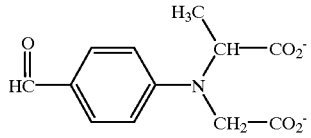
FED 19
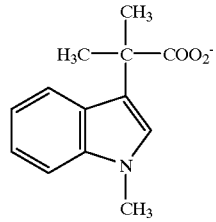
FED 20
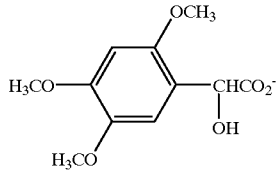
FED 21
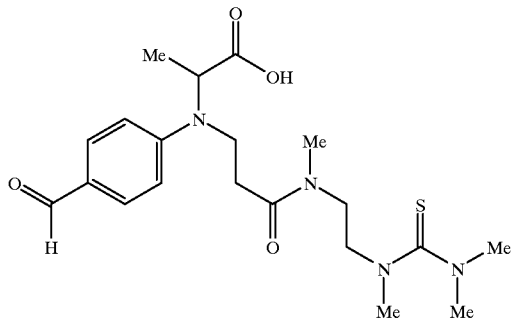
FED 22
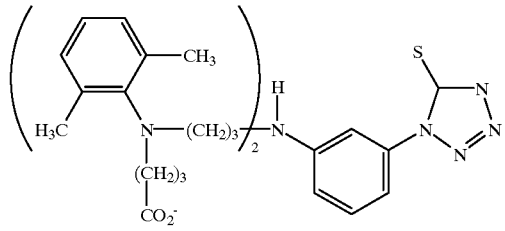
In a preferred form of the invention one or more spectral sensitizing dyes are adsorbed to the surfaces of the high bromide{111} tabular grains. In one specifically preferred form of the invention, the FED sensitizer includes a dye chromophore, providing the photon capture capability of a spectral sensitizing dye and the additional electron injection capability of a FED sensitizer. This allows a dye chromophore containing FED sensitizer to be substituted for a conventional spectral sensitizing dye. Spectral sensitizing dyes of conventional types and in conventional amounts are contemplated for use with the FED sensitizers. A FED sensitizer containing a chromophore, when employed in combination with one or more conventional spectral sensitizing dyes, can be chosen to absorb light in the same spectral region or a different spectral region than the conventional spectral sensitizing dye. As previously noted, a summary of spectral sensitizing dyes is provided by *Research Disclosure,* Item 38957, V. Spectral sensitization and desensitization, A. Sensitizing Dyes, cited above. Typically spectral sensitizing dyes are adsorbed to the surfaces of the grains after chemical sensitization, but advantages for dye addition to high bromide {111} tabular grains prior to or during chemical sensitization have long been recognized, as illustrated by Kofron et al U.S. Pat. No. 4,439,520. The FED sensitizer can be added to the emulsion prior to, during or following spectral sensitization.

The FED sensitizer can be incorporated in the emulsion by the conventional techniques for dispersing spectral sensitizing dyes. That is, the FED sensitizer can be added directly to the emulsion or added after being dissolved in a solvent, such as water, methanol or ethanol, or a mixture of solvents (e.g., an aqueous alcoholic solution). The FED sensitizers may also be added from solutions containing base and/or surfactants. The FED sensitizers may also be incorporated in aqueous slurries or peptizer dispersions.

FED sensitizers are added to the emulsions of the invention to allow intimate contact with the high bromide {111} tabular grains. In preferred forms the FED sensitizers are adsorbed to the grain surfaces. FED sensitizer concentrations in the emulsions of the invention can range from as low as $1\times10^{-31\ 8}$ mole per silver mole up to 0.1 mole per silver mole. A preferred concentration range is about $5\times10^{-7}$ to 0.05 mole per silver mole. It is appreciated that the more active forms of the FED sensitizer (e.g., those capable of injecting a higher number of electrons per molecule) can be employed in lower concentrations while achieving the same advantageous effects as less active forms. Although it is preferred that the FED sensitizer be added to the emulsion of the invention before, during or immediately following the addition of other conventional incorporated sensitizers, increases in emulsion sensitivity have been observed even when FED sensitizer addition has been delayed until after the emulsion has been coated.

In addition to high bromide {111} tabular grains, cationic starch peptizer, and FED sensitizer, usually in combination with conventional chemical and/or spectral sensitizers, the emulsions of the invention additionally preferably include one or more conventional antifoggants and stabilizers. A summary of conventional antifoggants and stabilizers is contained in *Research Disclosure,* Item 38957, VII. Antifoggants and stabilizers.

It has been observed that employing a FED sensitizer in combination with a cationic starch peptizer results in somewhat higher minimum densities than when a gelatino-peptizer is substituted, even when conventional antifoggants and stabilizers are present in the emulsion. It has been discovered that this incremental increase in minimum density can be reduced or eliminated by treating the emulsion with an oxidizing agent during or subsequent to grain precipitation. Preferred oxidizing agents are those that in their reduced form have little or no impact on the performance properties of the emulsions in which they are incorporated. Strong oxidizing agents noted above to be useful in oxidizing cationic starch, such as hypochlorite ($ClO^-$) or periodate ($IO_4^-$), are specifically contemplated. Specifically preferred oxidizing agents are halogen—e.g., bromine ($Br_2$) or iodine ($I_2$). When bromine or iodine is used as an oxidizing agent, the bromine or iodine is reduced to $Br^-$ or $I^-$. These halide ions can remain with other excess halide ions in the dispersing medium of the emulsion or be incorporated within the grains without adversely influencing photographic performance. Any level of oxidizing agent can be utilized that is effective in reducing minimum density. Concentrations of oxidizing agent added to the emulsion as low as about $1\times10^{-6}$ mole per Ag mole are contemplated. Since very low levels of $Ag^o$ are responsible for increases in minimum density, no useful purpose is served by employing oxidizing agent concentrations of greater than 0.1 mole per Ag mole. A specifically preferred oxidizing agent range is from $1\times10^{-4}$ to $1\times10^{-2}$ mole per Ag mole. The silver basis is the total silver at the conclusion of precipitation of the high bromide {111} tabular grain emulsion, regardless of whether the oxidizing agent is added during or after precipitation.

The dye image forming layer unit contains one or more one equivalent image dye-forming couplers. As herein employed, the term "coupler" is employed in its art recognized sense of denoting a compound that reacts with a quinonediimine derived from an oxidized p-phenylenediamine color developing agent during photographic element development to perform a photographically useful function. A one equivalent image dye-forming coupler can be viewed as a two or four equivalent image dye-forming coupler modified to contain a leaving group that (a) provides the activation for coupling of leaving groups found in two equivalent image dye-forming couplers and (b) contains a dye chromophore capable of contributing to dye image density. In other words, one equivalent image dye-forming couplers can be viewed as being made up of conventional coupling moieties (COUP) of the type found in image dye-forming couplers generally and leaving moieties (LG) that are specifically selected to impart one equivalent coupling.

The image dye-forming couplers summarized in *Research Disclosure,* Item 38957, X. Dye image formers and modifiers, B. Image-dye-forming couplers contain coupling moieties COUP of the type found in the one equivalent image dye-forming couplers contemplated for use in the image dye forming layer units of the photographic elements of this invention. Although many varied forms of COUP moieties are known, most COUP moieties have been synthesized to facilitate formation of image dyes having their main absorption in the red, green, or blue region of the visible spectrum.

For example, couplers which form cyan dyes upon reaction with oxidized color developing agents are described in such representative patents and publications as: U.S. Pat. Nos. 2,772,162; 2,895,826; 3,002,836; 3,034,892; 2,474,293; 2,423,730; 2,367,531; 3,041,236; 4,333,999; and "Farbkuppler: Eine Literaturubersicht," published in Agfa Mitteilungen, Band III, pp. 156–175 (1961). In the coupler moiety COUP structures shown below, the unsatisfied bond indicates the coupling position to which the leaving moiety LG is attached.

Preferably such cyan dye-forming couplers are phenols and naphthols which form cyan dyes on reaction with oxidized color developing agent at the coupling position, i.e. the carbon atom in the 4-position of the phenol or naphthol.

Preferred COUP moieties of the type found in cyan dye-forming couplers are:

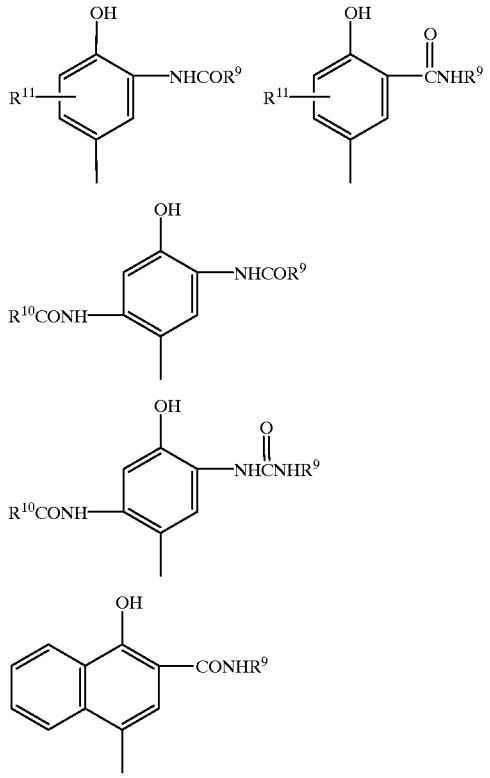

wherein $R^9$ and $R^{10}$ can represent a ballast group or a substituted or unsubstituted alkyl or aryl group, and $R^{11}$ represents one or more halogen (e.g. chloro, fluoro), alkyl having from 1 to 4 carbon atoms or alkoxy having from 1 to 4 carbon atoms.

Couplers which form magenta dyes upon reaction with oxidized color developing agent are described in such representative patents and publications as: U.S. Pat. Nos. 2,600,788; 2,369,489; 2,343,703; 2,311,082; 3,824,250; 3,615,502; 4,076,533; 3,152,896; 3,519,429; 3,062,653; 2,908,573; 4,540,654; and "Farbkuppler: Eine Literaturubersicht," published in Agfa Mitteilungen, Band III, pp. 126–156 (1961).

Preferably such magenta dye-forming couplers are pyrazolones and pyrazolotriazoles which form magenta dyes upon reaction with oxidized color developing agents at the coupling position—i.e., the carbon atom in the 4-position for pyrazolones and the 7-position for pyrazolotriazoles. Preferred COUP moieties of the type found in magenta dye-forming couplers are:

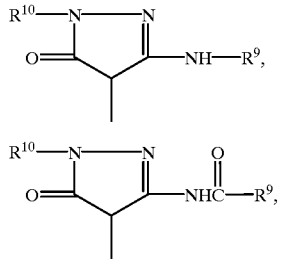

-continued

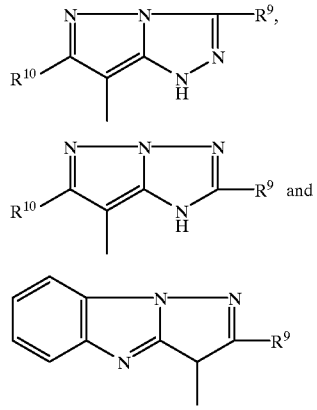

wherein $R^9$ and $R^{10}$ are as defined above. $R^{10}$ for pyrazolone structures is typically phenyl or substituted phenyl, such as, for example, 2,4,6-trihalophenyl, and for the pyrazolotriazole structures $R^{10}$ is typically alkyl or aryl.

Couplers which form yellow dyes upon reaction with oxidized color developing agent are described in such representative patents and publications as: U.S. Pat. Nos. 2,875,057; 2,407,210; 3,265,506; 2,298,443; 3,048,194; 3,447,928; and "Farbkuppler: Eine Literaturubersicht," published in Agfa Mitteilungen, Band III, pp. 112–126 (1961).

Preferably such yellow dye-forming couplers are acylacetamides, such as benzoylacetanilides and pivalylacetanilides. These couplers react with oxidized developer at the coupling position—i.e., the active methylene carbon atom. Preferred COUP moieties of the type found in yellow dye-forming couplers are:

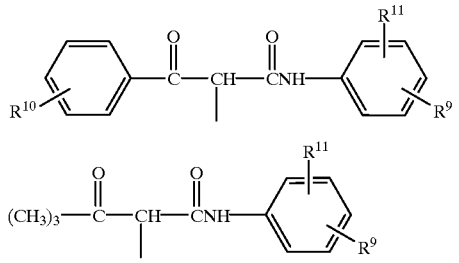

wherein $R^9$ and $R^{10}$ are as defined above and can also be hydrogen, alkoxy, alkoxycarbonyl, alkanesulfonyl, arenesulfonyl, aryloxycarbonyl, carbonamido, carbamoyl, sulfonamido, or sulfamoyl, and $R^{11}$ is hydrogen or one or more halogen, lower alkyl (e.g. methyl, ethyl), lower alkoxy (e.g., methoxy, ethoxy), or a ballast (e.g. alkoxy of 16 to 20 carbon atoms) group.

The leaving group LG differs from the leaving groups of two equivalent image dye-forming couplers in that LG itself contains a dye chromophore. If the dye chromophore of LG exhibits the same hue before and after separation from COUP, it does not contribute to forming a dye image, but simply increases dye density uniformly in all image areas. To obtain a desired image dye light absorption when LG is released from COUP while avoiding unwanted light absorption by the dye chromophore in LG when LG remains attached to COUP, conventional LG constructions are chosen to produce a bathochromic shift of light absorption in released LG as compared to COUP attached LG. For example, assuming that a yellow (blue light absorbing) dye image is sought, LG can be constructed to contain an ultraviolet absorbing dye chromophore when attached to COUP, and release from COUP can result in shifting absorption bathochromically into the blue region of the spectrum, thereby changing the perceived hue of the LG incorporated dye from essentially colorless to yellow. With LG constructions permitting longer wavelength bathochromic shifts, the LG hue can shift from essentially colorless (UV absorbing) to green or even red. For green and red absorbing dyes in released LG, it is recognized that initial (COUP attached) LG absorption may, depending upon the construction chosen, extend into the visible region of the spectrum. This initially visible absorption is lost when LG is released. The loss of light absorption in a selected region of the visible spectrum as a result of a coupling reaction is a property also exhibited by conventional masking couplers, commonly used in color negative films for color correction. Thus, it is possible to choose the initial absorption of LG as attached to COUP so that the absorption shift on release performs the function of a masking coupler.

LG can take the form of any conventional one equivalent coupler leaving group. One equivalent couplers having leaving groups suitable for use in the image forming layer units of the photographic elements of the invention are described in Lau U.S. Pat. No. 4,248,962 and Mooberry et al U.S. Pat. Nos. 4,840,884, 5,447,819 and 5,457,004, the disclosures of which are here incorporated by reference. The one equivalent image dye-forming couplers of Mooberry et al are preferred, since they do not require mordanting on release to retain their desired hue. Viewed another way, the Mooberry et al one equivalent image dye-forming couplers can contain release dyes that are charge neutral.

Preferred one equivalent image dye-forming couplers include the following components:

$$\text{COUP—L}_n\text{—B—N(R}^1\text{)—DYE}$$

COUP is the coupler moiety described above, and the structure to the right of COUP forms LG.

DYE is an image dye or image dye precursor and can include an auxochrome associated with the dye, where an auxochrome is a group that increases dye absorption intensity.

$L_n$-B is a linking group that is at least divalent. n is zero or 1. The COUP bond and the B-N($R^1$) bond are both cleaved under conditions permitting coupling off to occur. Cleaving the B-N($R^1$) bond bathochromically shifts the hue of the DYE.

B can be chosen from among —OC(O)—, —OC(S)—, —SC(O)—, —SC(S)— or —OC(=$NSO_2R$)—, where R is a substituted or unsubstituted alkyl or aryl group. B in the form of —OC(=$NSO_2R$)— and —OC(O)—, particularly the latter, is preferred to maintain the lowest possible densities in unexposed areas.

N($R^1$) either forms a part of the auxochrome or chromophore of DYE. Illustrative groups in which —N($R^1$)— forms a part of an auxochrome are as follows:

The nitrogen atom in —$NR^1$— is optionally located in an auxochrome, that is a group that intensifies the color of the dye, or it is optionally an integral part of the dye chromophore.

Illustrative groups wherein —$NR^1$— is part of auxochrome are as follows:

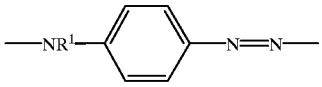

-continued

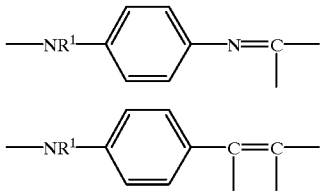

Illustrative groups in which —N($R^1$)— forms a part of a dye chromophore are as follows:

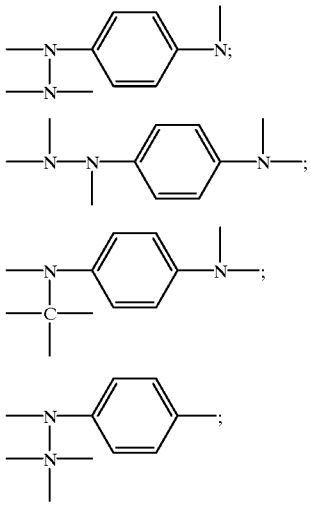

The particular linking group $L_n$—B can be varied to help control such parameters as rate and time of release of the —$NR^1$— DYE group. The particular linking group $L_n$—B employed, including the nature of the substituents on $L_n$—B, can additionally control the rate and distance of diffusion of the unit formed by the group $L_n$—B, the —$NR^1$— group and the DYE after this unit is released from the coupler moiety but before the —$NR^1$— DYE is released. The linking group $L_n$—B preferably causes a spectral shift in absorption of DYE as a function of attachment to —$NR^1$—. Also, the linking group $L_n$—B preferably stabilizes the DYE to oxidation, particularly wherein the —$NR^1$— is part of the chromophore.

The coupler moiety COUP can be any moiety which will react with oxidized color developing agent to cleave the bond between the linking group and the coupler moiety. It includes coupler moieties employed in conventional color-forming couplers which yield colorless products on reaction with oxidized color developing agents as well as coupler moieties which yield colored products on reaction with oxidized color developing agents. Both types of coupler moieties are well known to those skilled in the art.

The coupler moiety can be unballasted or ballasted with an oil-soluble or fat-tail group. It can be monomeric, or it can form part of a dimeric, oligomeric or polymeric coupler, in which case more than one —Ln—B—$NR^1$—DYE unit can be contained in the coupler.

It will be appreciated that, depending upon the particular coupler moiety, the particular color developing agent and the type of processing, the reaction product of the coupler moiety and oxidized color developing agent can be: (1) colored and nondiffusible, in which case it will remain in the location where it is formed; (2) colored and diffusible, in which case it may be removed during processing from the location where it is formed or allowed to migrate to a different location; or (3) colorless.

The —$L_n$—B—$NR^1$—DYE unit is joined to the coupler moiety at any of the positions from which groups released from couplers by reaction with oxidized color developing agent can be attached. The —$L_n$—B—$NR^1$—DYE unit is attached at the coupling position of the coupler moiety so that upon reaction of the coupler with oxidized color developing agent the —$L_n$—B—$NR^1$—DYE will be displaced.

The linking group $L_n$—B can be any organic group which will serve to connect COUP to the —$NR^1$— group and which, after cleavage from COUP will cleave from the —$NR^1$— group, for example by an elimination reaction of the type described in, for example, U.S. Pat. No. 4,409,323. The elimination reaction involves electron transfer down a conjugated chain. As used herein the term "electron transfer down a conjugated chain" is understood to refer to transfer of an electron along a chain of atoms in which alternate single bonds and double bonds occur. A conjugated chain is understood to have the same meaning as commonly used in organic chemistry. Electron transfer down a conjugated chain is as described in, for example, U.S. Pat. No. 4,409,323.

The group $L_n$—B can contain moieties and substituents which will permit control of one or more of the following rates: (i) the rate of reaction of COUP with oxidized color developing agent, (ii) the rate of diffusion of —$L_n$—B—$NR^1$—DYE and (iii) the rate of release of DYE. The linking group $L_n$—B can contain additional substituents or precursors thereof which may remain attached to the linking group or be released.

Illustrative linking groups include:

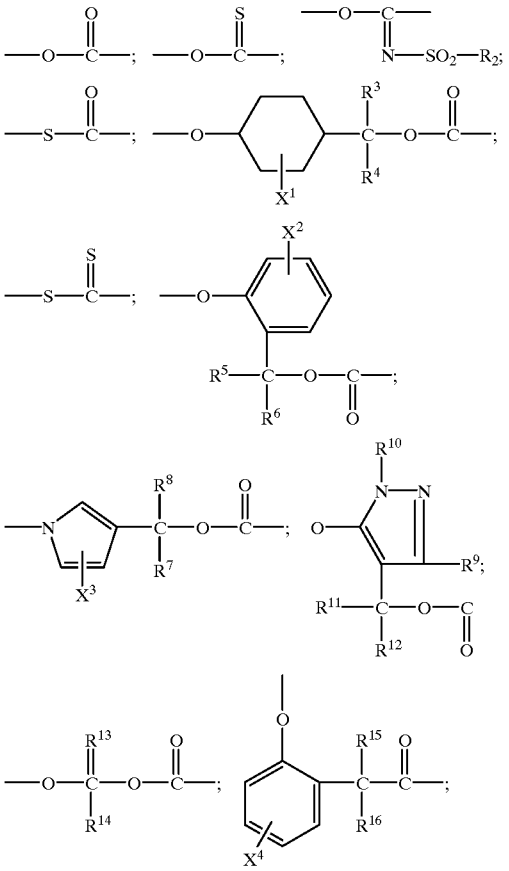

-continued

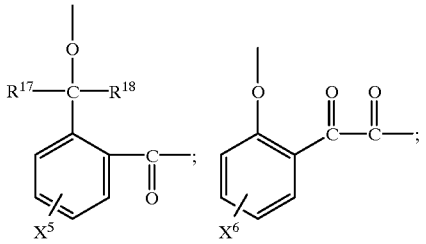

wherein $X^1$ through $X^6$ and $R^1$ through $R^{18}$ are substituents that do not adversely affect the described COUP—$L_n$—B—$NR^1$—DYE. For example, $R^1$ through $R^{18}$ are individually hydrogen, unsubstituted or substituted alkyl, such as alkyl containing 1 to 30 carbon atoms, for example, methyl, ethyl, propyl, n-butyl, t-butyl, pentyl and eicosyl; or cycloalkyl, such as cyclopentyl, cyclohexyl and 4-methoxycyclohexyl; or aryl, such as unsubstituted or substituted phenyl. $X^1$ through $X^6$ can be hydrogen or a substituent that does not adversely affect the described COUP—$L_n$—B—$NR^1$—DYE, such as electron withdrawing or donating groups, for example, alkyl, such as methyl, ethyl, propyl, n-butyl, t-butyl and eicosyl, halogen, such as chlorine and bromine, nitro, carbamyl, acylamido, sulfonamido, sulfamyl, sulfo, carboxyl, cyano, and alkoxy, such as methoxy and ethoxy, acyl, sulfonyl, hydroxy, alkoxycarbonyl, and aryloxy. The linking group $L_n$—B can be, for example, a linking group within U.S. Pat. No. 4,409,323 or a nucleophilic displacement type linking group as described in, for example, U.S. Pat. No. 4,248,962, or a linking group which is a combination of these two types.

A particularly useful $L_n$-B linking group is represented by the formula:

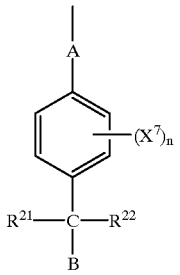

wherein A is O, S, or sulfonamido (N—$SO_2R^{23}$);

B is as previously defined;

$R^{21}$ and $R^{22}$ are individually hydrogen, or substituted or unsubstituted alkyl, such as methyl, ethyl, propyl, n-butyl or t-butyl, or aryl, such as unsubstituted or substituted phenyl;

$X^7$ is a substituent as described for $X^1$, that does not adversely affect the coupler; and n is 0, 1, 2, 3 or 4. $R^{23}$ is a substituent, typically alkyl or aryl. Typically $R^{21}$ and $R^{22}$ are hydrogen.

Preferred $L_n$-B linking groups include:

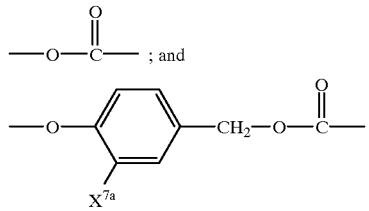

wherein $X^{7a}$ is hydrogen, chlorine, methylsulfonamido ($NHSO_2CH_3$), —$COOCH_3$, —$NHCOCH_3$, —$CONHCH_3$, —$COHNCH_2$ COOH, —COOH or $CON(CH_3)_2$.

A particularly useful linking group is represented by the formula:

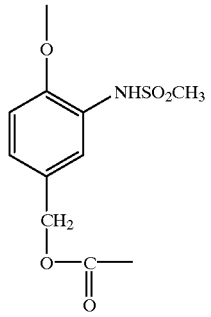

The linking group and DYE optionally contain substituents that can modify the rate of reaction, diffusion, or displacement, such as halogen, including fluoro, chloro, bromo, or iodo, nitro, alkyl of 1 to 20 carbon atoms, acyl, carboxy, carboxyalkyl, alkoxycarbonyl, alkoxycarbonamido, alkylcarbamyl, sulfoalkyl, alkylsulfonamido, and alkylsulfonyl, solubilizing groups, ballast groups and the like. For example, solubilizing groups will increase the rate of diffusion and ballast groups will decrease the rate of diffusion.

The $R^1$ substituent on —$NR^1$— can be any substituent that does not adversely affect the coupler (A). When the —$NR^1$— is part of an auxochrome, $R^1$ can be, for example, hydrogen or alkyl, such as alkyl containing 1 to 30 carbon atoms, including methyl, ethyl, propyl, n-butyl, t-butyl or eicosyl, or aryl, such as phenyl. When the nitrogen atom attached to $L_n$-B is part of a chromophore, $R^1$ becomes an integral part of the chromophore.

Preferred $R^1$ groups are alkyl, such as alkyl containing 1 to 18 carbon atoms when $R^1$ is part of the dye auxochrome. $R^1$ when part of the chromophore is, for example, unsubstituted or substituted aryl, such as phenyl.

The DYE as described includes any releasable, electrically neutral dye that enables dye hue stabilization without mordanting the dye formed. The release mechanism can be initiated by oxidized reducing agent.

The particular DYE and the nature of the substituents on the DYE can control whether or not the dye diffuses and the rate and distance of diffusion of the DYE formed. For example, the DYE can contain a ballast group known in the photographic art that hinders or prevents diffusion. The DYE can contain a water solubilizing group, such as a carboxy group, to help diffusion of the DYE. Such groups are known to those skilled in the art.

Particularly useful classes of DYE moieties are:

I. Azo dye moieties including the —$NR^1$— group represented by the structure:

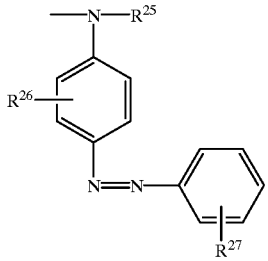

wherein $R^{25}$, $R^{26}$ and $R^{27}$ are individually hydrogen or a substituent, such as alkyl.

II. Azamethine dye moieties including the —$NR^1$— group represented by the structure:

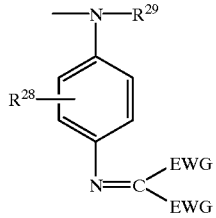

wherein $R^{28}$ is hydrogen or a substituent, such as alkyl; $R^{29}$ is hydrogen or a substituent, such as alkyl; and EWG is an electron withdrawing group.

III. Methine dye moieties including the —$NR^1$— group represented by the structure:

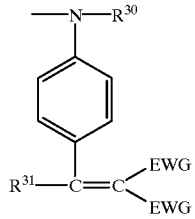

wherein $R^{30}$ is hydrogen or a substituent, such as alkyl; $R^{31}$ is hydrogen or a substituent such as alkyl; and EWG is an electron withdrawing group.

The term DYE also includes dye precursors wherein the described substituted nitrogen atom is an integral part of the chromophore, also described herein as leuco dye moieties. Such dye precursors include, for example:

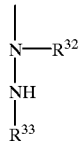

wherein $R^{32}$ and $R^{33}$ are aryl, such as substituted phenyl.

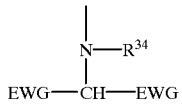

wherein $R^{34}$ is an aryl group, such as substituted phenyl; and EWG is an electron withdrawing group.

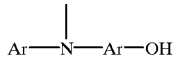

wherein Ar are individually substituted aryl groups, particularly substituted phenyl groups. When the DYE moiety is a leuco dye, $L_n$-B preferably comprises a timing group that enables delay of oxidation of the leuco dye by silver halide in a photographic silver halide element. For example, it is preferred that $L_n$-B be a

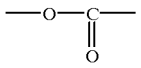

group when DYE is a leuco dye moiety as described.

Examples of cyan, magenta, yellow and leuco dyes are as follows:

A. Cyan

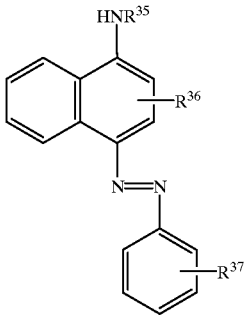

wherein $R^{35}$ is a substituent that does not adversely affect the dye, such as alkyl; $R^{36}$ is a substituent, such as an electron releasing group; and $R^{37}$ is a substituent, such as a strong electron withdrawing group.

B. Magenta

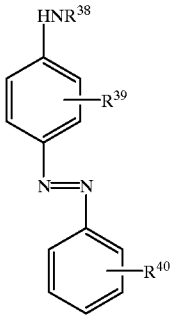

wherein $R^{38}$ is a substituent that does not adversely affect the dye, such as alkyl; $R^{39}$ is a substituent, such as an electron releasing group; and $R^{40}$ is a substituent, such as a strong electron withdrawing group.

C. Yellow

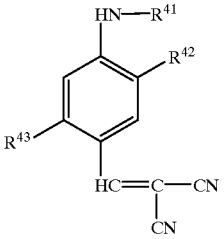

wherein $R^{41}$ is alkyl; $R^{42}$ is alkoxy; and $R^{43}$ is alkyl; and

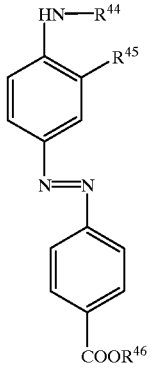

wherein $R^{44}$ is alkyl; $R^{45}$ is alkoxy; and $R^{46}$ is alkyl or aryl.

D. Leuco

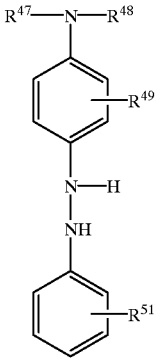

wherein $R^{47}$ and $R^{48}$ are individually hydrogen or alkyl; $R^{49}$ is an electron releasing group; and $R^{51}$ is a strong electron withdrawing group.

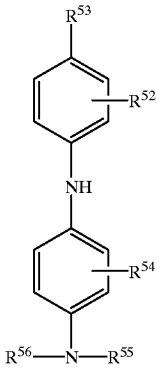

wherein $R^{52}$ and $R^{54}$ are individually hydrogen or a substituent; $R^{53}$ is a hydroxyl, $NHR^a$ or NHSO2 $R^a$ wherein $R^a$ is a substituent; $R^{55}$ and $R^{56}$ are individually hydrogen or a substituent.

The following are specific illustrations of one equivalent image dye-forming couplers contemplated for use in the practice of this invention:

OEC-1
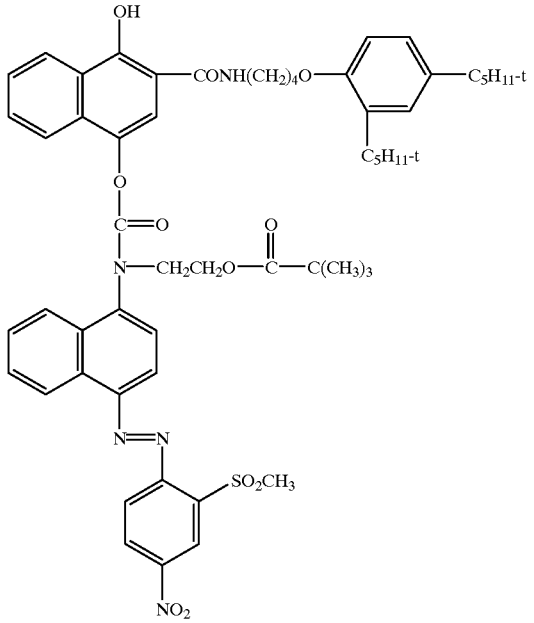
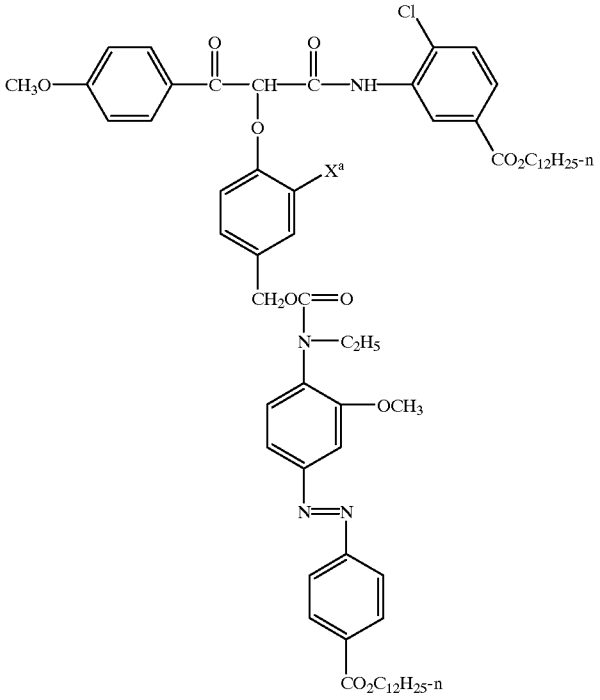
OEC-2
$X^a$=NHCOCH$_3$
OEC-3
$X^a$=NHSO$_2$CH$_3$

-continued
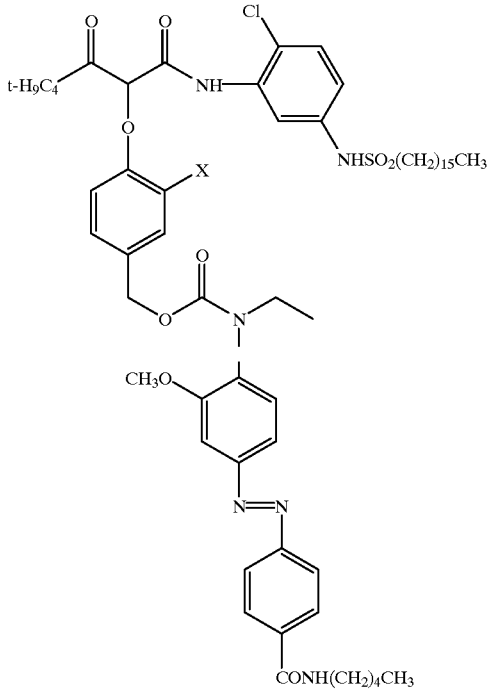
OEC-4
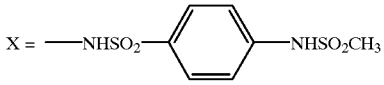
OEC-5
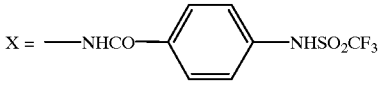
OEC-6
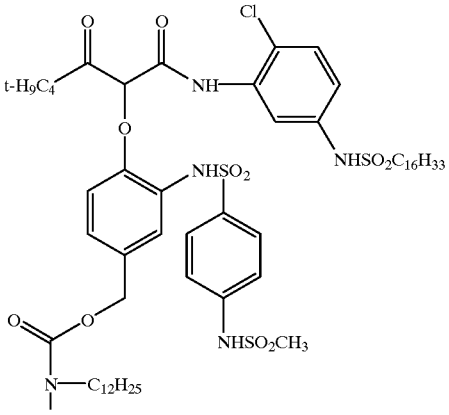

-continued
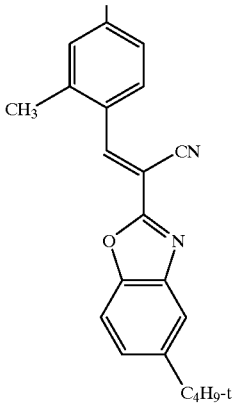
OEC-7
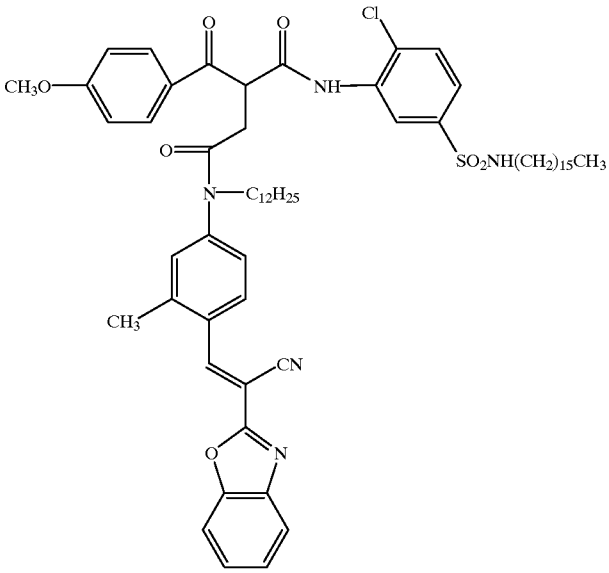
OEC-8
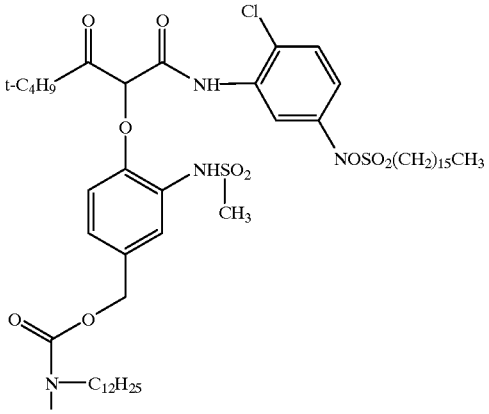

-continued
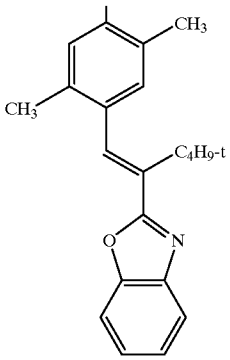
OEC-9
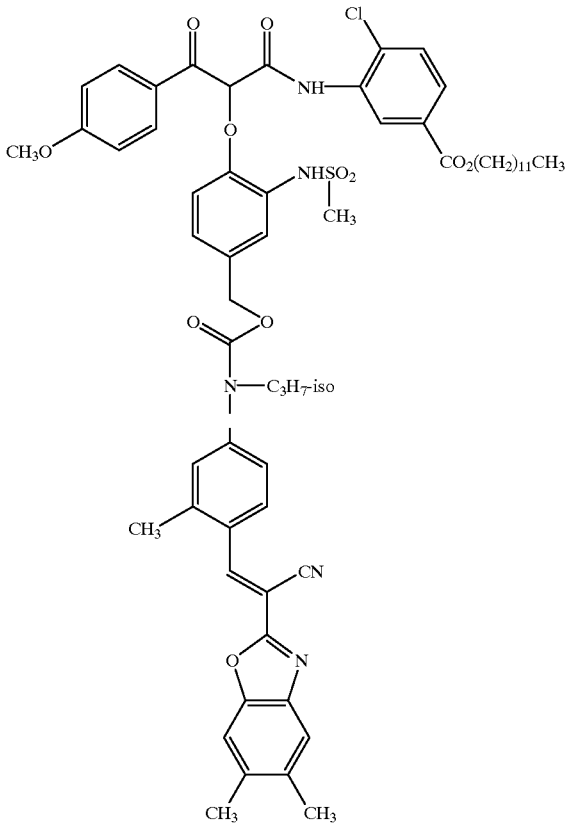
OEC-10
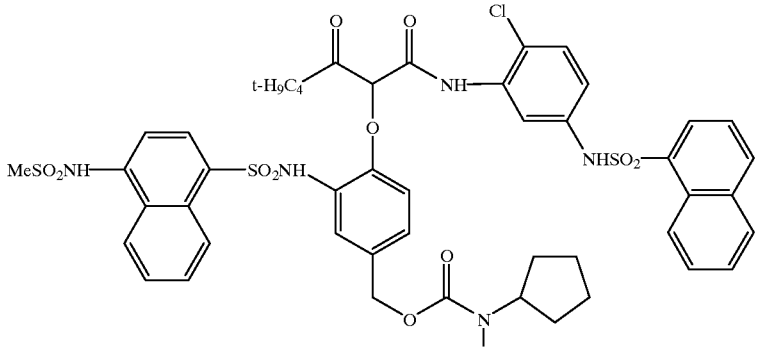

-continued

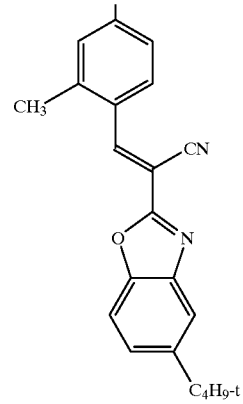

OEC-11

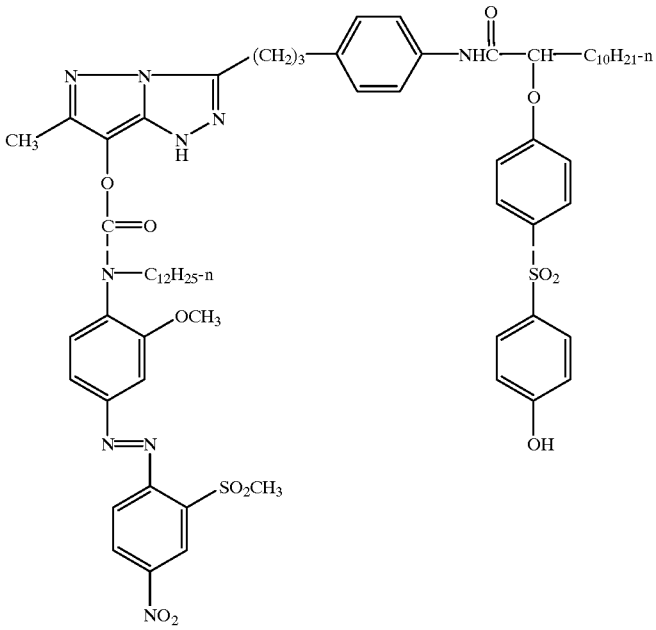

In addition to one equivalent image dye-forming coupler the image forming layer unit can, if desired, contain one or more other conventional couplers. For example, it is contemplated to employ one or more four equivalent or, particularly, two equivalent image dye-forming couplers in combination with an image dye-forming one equivalent coupler. When image dye-forming couplers are used in combination, it is preferred that at least 20 percent on a mole basis of image dye-forming coupler present be provided by one or more one equivalent image dye-forming couplers.

In addition to image dye-forming coupler, the image forming layer unit can, if desired, contain one or more dye image modifying couplers. These couplers, which often do not form an image dye on coupling, can be relied upon for immediate or timed release of photographically useful fragments, such as development accelerators, development inhibitors, bleach accelerators, bleach inhibitors, developing agents (e.g., competing or auxiliary developing agents), silver complexing agents, fixing agents, toners, hardeners, tanning agents, antistain agents, stabilizers, antifoggants, competing couplers, and chemical or spectral sensitizers or desensitizers. A summary of dye image modifying couplers is provided by *Research Disclosure,* Item 38957, C. Image dye modifiers.

Element I illustrates a photographic element according to the invention having its construction reduced to essential features.

| Element I |
|---|
| Emulsion Layer Unit<br>Support |

The Emulsion Layer Unit can consist of a single high bromide {111} tabular grain emulsion containing a cationic starch peptizer, a FED sensitizer, and a one equivalent image dye-forming coupler as described above. The cationic starch peptizer added during emulsion precipitation typically forms only a small portion of the total vehicle of the emulsion layer. Additional cationic starch of the type used as a peptizer can be added to act as a binder. However, it is preferred to employ as binders other conventional hydrophilic colloid binders, particularly gelatin and gelatin derivatives. Maskasky U.S. Pat. No. 5,726,008, here incorporated by reference, describes a vehicle that can be chill set containing at least 45 percent by gelatin and at least 20 percent of a water dispersible starch. In addition to peptizer and binder, the vehicle is reacted with a hardener to increase its physical integrity as a coating and other addenda, such as latices, are also commonly incorporated. Conventional components which can be included within the vehicle of the emulsion layer summarized in *Research Disclosure,* Item 38957, II. Vehicles, vehicle extenders, vehicle-like addenda and vehicle related addenda and IX. Coating physical property modifying addenda—e.g., coating aids (such as surfactants), plasticizers and lubricants, matting agents and antistats are common vehicle components, conventional choices being illustrated by *Research Disclosure,* Item 38957, IX. Coating physical property modifying addenda.

The Support can take the form of any conventional photographic element support. Typically the Support is either transparent (e.g., a transparent film support) or a white reflective support (e.g., a photographic paper support). A listing of photographic element supports is provided in *Research Disclosure,* Item 38957, XV. Supports. In the majority of applications higher imaging speeds have been particularly sought for camera speed or "taking" films that have a transparent support. When the film has a transparent support and forms a negative dye image, the image bearing processed film is most commonly used as an exposure master for creating a viewable positive image in a print element (e.g., color paper). When the film has a transparent support and forms a positive dye image, the image is most commonly viewed directly by protection. Where the dye image in the film is to be retrieved by scanning, a taking film of increased speed can be realized by employing a reflective support. It is specifically contemplated to employ a support that is specularly reflective at the time of imagewise exposure, thereby increasing its imaging speed, but is converted to a transparent form during processing to facilitate conventional uses of taking films. Maskasky et al U.S. Ser. No. 09/118,172, filed Jul. 17, 1998, titled DYE IMAGE FORMING PHOTOGRAPHIC ELEMENT AND PROCESSING TO PRODUCE A VIEWABLE IMAGE, commonly assigned to discloses employing a transparent film support bearing a silver mirror coating that is capable of removal during photographic processing.

In practice, additional features are usually present in a photographic element construction. Elements IIa and IIb illustrate common photographic element constructions useful for chromogenic black-and-white imaging or producing a single color dye image.

| Element IIa |
|---|
| Protective Overcoat |
| Emulsion Layer Unit |
| Antihalation Layer |
| Support |
| Magnetic Imaging Layer |
| **Element IIb** |
| Protective Overcoat |
| Emulsion Layer Unit |
| Support |
| Pelloid Layer |
| Magnetic Imaging Layer |

The Support can take any of the forms described above—i.e., any conventional form. In Element IIa the Antihalation Layer is interposed between the Support and the Emulsion Layer Unit. When the Support is transparent, the Antihalation Layer can be moved to be back side of the Support, as shown in Element IIb, and becomes the Pelloid Layer. The Pelloid Layer also acts as both an antihalation layer and an anti-curl layer. The Antihalation Layer and Pelloid Layer each contain one or more dyes capable of being rendered colorless (i.e., discharged) during photographic processing. Dyes of this type are listed in *Research Disclosure,* Item 38957, VII. Absorbing and scattering materials, B. Absorbing materials and C. Discharge.

The Protective Overcoat is provided to protect the Emulsion Layer Unit. Each of the Antihalation Layer, Pelloid Layer and Protective Overcoat contain a vehicle. The vehicle is comprised of binder, hardener, and selections of the remaining components of the emulsion layer described above. The surface layers, the Pelloid Layer and the Protective Overcoat, are particularly preferred locations for surface modifying addenda, such as lubricants, matting agents and antistats. The Protective Overcoat is also a preferred location for the incorporation of UV stabilizers, a summary disclosure of which is provided in *Research Disclosure,* Vol. 370, February 1995, Item 37038, X. UV Stabilizers.

The Magnetic Imaging Layer is an optional, but preferred layer having as its purpose to store information about the photographic element for use in exposure or subsequent processing. Magnetic imaging layers are illustrated by *Research Disclosure,* Item 38957, XIV. Scan facilitating features and James U.S. Pat. Nos. 5,254,441 and 5,254,449.

Although the Emulsion Layer Unit can consist of a single emulsion layer, it is recognized that the Emulsion Layer Unit can contain a blend of invention emulsions or a blend of one or more invention emulsions and one or more conventional emulsions. It is also common practice to divide emulsion layer units into two or three separate emulsion layers, differing in imaging speed.

By forming the Emulsion Layer Unit of a faster emulsion layer and a slower emulsion layer, with the faster emulsion layer positioned to receive exposing radiation (i.e., positioned farther from the support) first, a higher speed is realized than when the faster and slower emulsions are blended in a single layer. When the slower emulsion layer is positioned to first receive exposing radiation, a higher contrast is realized than when the faster and slower emulsions are blended and coated in a single layer. When three separate emulsions are coated, the third emulsion layer is interposed between the faster and slower emulsions and is chosen to exhibit an intermediate speed. The function of the third emulsion layer is to allow longer exposure latitudes to be realized. Chang and Friday U.S. Pat. Nos. 5,314,793 and 5,360,703, here incorporated by reference, disclose emulsion layer units containing three emulsion layers differing in speed to provide a useful exposure latitude of greater than 1.0 log E.

When one or more other emulsions are employed in combination with an emulsion satisfying the grain, peptizer and coupler requirements of the invention (hereinafter referred to as the invention emulsion), they can be chosen from among conventional negative-working radiation-sensitive silver halide emulsions, such as those described in *Research Disclosure,* Item 38957, I. Emulsion grains and their preparation, with paragraph E. Blends, layers and performance categories, further illustrating emulsion combinations. When one or more conventional emulsions are employed in combination with one or more invention emulsions, the invention emulsions are preferred choices for higher speeds, since they exhibit unexpectedly high speeds. When a conventional emulsion is present in an Emulsion Layer Unit with an invention emulsion, it is preferably also a high (>50 mole percent, based on silver) bromide emulsion, and it is in most instances also a tabular grain emulsion.

The photographic elements of the invention can rely on a combination of developed silver and image dye to produce a viewable image. Application of the invention to chromogenic black-and-white imaging is specifically contemplated.

In the majority of applications it is contemplated to rely entirely upon image dye to produce a viewable image. Elements I, IIa and IIb can be employed to form a positive dye image. Positive dye images are preferably formed by color reversal processing—that is, development of the imagewise exposed element without dye formation followed by a second, dye image forming development step in which residual silver halide not developed in the first development step is developed. Color reversal processing and element features particularly contemplated for photographic elements intended for color reversal processing are summarized in *Research Disclosure,* Item 38957, XIII. Features applicable only to color positive, B. Color reversal, and XVIII. Chemical development systems, B. Color-specific processing systems, paragraph (1).

In a specifically preferred form, the photographic elements of the invention produce negative dye images. Color negative processing and element features particularly contemplated for photographic elements intended for color reversal processing are summarized in *Research Disclosure,* Item 38957, XII. Features applicable only to color negative and XVIII. Chemical development systems, B. Color-specific processing systems, paragraphs (3) through (10).

In all forms of processing development occurs in the presence of a para-phenylenediamine color developing agent. At least one of the amino groups of the phenylene ring is a primary amino group. Preferred color developing agents are the N,N-dialkyl- p-phenylenediamines, such as N,N-diethyl-p-phenylenediamine monohydrochloride, 4-N,N-diethyl-2-methylphenylenediamine monohydrochloride, 4-(N-ethyl-N-2-methanesulfonylaminoehtyl)-2-methylphenylenediamine sesquisulfate monohydrate, and 4-(N-ethyl-N-2-hydroxyethyl)-2-methylphenylenediamine sulfate. Further illustrations of para-phenylenediamine color developing agents are provided by *Research Disclosure,* Item 38957, XIX. Development, A. Developing agents and James *The Theory of the Photographic Process,* 4th Ed., Macmillan, New York, 1977, Chapter 12 Principles and Chemistry of Color Photography, III. Color Forming Agents, A. Color Developers.

The following is a typical construction of a full color recording photographic element according to the invention—that is, an element capable of recording sufficient image information to allow the image and colors of the photographic subject to be reproduced, either within the color recording photographic element itself or in another color recording photographic element:

| Color Recording Element |
|---|
| Protective Overcoat |
| 3rd Color Recording Layer Unit |
| 2nd Interlayer |
| 2nd Color Recording Layer Unit |
| 1st Interlayer |
| 1st Color Recording Layer Unit |
| Undercoat |
| Transparent Film Support |
| Pelloid |
| Magnetic Imaging Layer |

The Support and the $1^{st}$, $2^{nd}$ and $3^{rd}$ Color Recording Layer Units are essential components for all color recording applications. The remaining components are either optional or required only in specific applications. The Protective Overcoat, Transparent Film Support, Pelloid and Magnetic Imaging Layer have been described above and require no further comment.

Each of the Recording Layer Units is an Emulsion Layer Unit constructed of the components described above, except as noted below, that has been chosen to be responsive to one of the blue, green and red portions of the visible spectrum. At least one invention emulsion is present in at least one and preferably each of the Recording Layer Units. Any one of the following layer unit sequences is possible:

| | |
|---|---|
| SQ-1 | \|B\|G\|R\|S\|, |
| SQ-2 | \|B\|R\|G\|S\|, |
| SQ-3 | \|G\|R\|B\|S\|, |
| SQ-4 | \|R\|G\|B\|S\|, |
| SQ-5 | \|G\|B\|R\|S\|, and |
| SQ-6 | \|R\|B\|G\|S\| |

where

B=Blue Recording Layer Unit,

G=Green Recording Layer Unit,

R=Red Recording Layer Unit, and

S=Transparent Film Support.

Each of the blue, green and red recording layer units contains a dye image providing compound that produces a dye image of a different hue. Preferably each of the blue, green and red recording layer units contains the combination of a starch peptized high bromide {111} tabular grain emulsion, a FED sensitizer and a one equivalent image dye-forming coupler. When the dye images in the Color Recording Element are intended for direct viewing (e.g., when forming a color slide image or when used as an exposure master for a color print element), the blue, green and red recording layer units are constructed to produce yellow, magenta and cyan dye images, respectively. Preferably the Blue Recording Layer Unit contains a yellow dye-forng couper, the Green Recording Layer Unit contains a magenta dye-forming coupler, and the Red Recording Layer Unit contains a cyan dye-forming coupler. In addition, conventional image dye modifiers can be incorporated in the Recording Layer Unit.

The $1^{st}$ and $2^{nd}$ Interlayers and the Undercoat can contain the same selections of vehicles as described above. The Undercoat can be replaced by the Antihalation Layer described above allowing the Pelloid can be omitted. The $1^{st}$ and $2^{nd}$ Interlayers preferably contain oxidized developing agent scavengers to prevent color developing agent oxidized in one layer unit from migrating to an adjacent layer unit. Typical oxidized developing agent scavengers include ballasted (i.e., immobilized) hydroquinone and aminophenol developing agents.

When image information is intended to be read from the photographic elements of the invention by reflection and/or transmission scanning, it is entirely feasible, but no longer of any importance, to form an image that is pleasing to the eye, as in color reversal films, or to form a negative image that can be exposed through to obtain a visually pleasing positive image, as in most color negative films. It is merely necessary that the $1^{st}$, $2^{nd}$ and $3^{rd}$ Layer Units when exposed and processed contain a retrievable record of the subject, including its color. False color records are just as useful for this purpose as natural color records, and it is, in fact, possible to form three retrievable color records without actually forming three dye images. Color negative films intended solely for scanning do not require masking couplers. Bohan U.S. Pat. No. 5,434,038 discloses a color negative film containing a masking coupler that is equally suited for image retrieval by printing or scanning. Color recording photographic element constructions specifically adapted for the scan retrieval of image information are illustrated by *Research Disclosure,* Item 38957, XIV. Scan facilitating features, Paragraph (1). In addition, the disclosures of the following more recently issued patents of color recording photographic element constructions particularly adapted for scan image retrieval are here incorporated by reference: Sutton et al U.S. Pat. Nos. 5,300,413 and 5,334,469, Sutton U.S. Pat. Nos. 5,314,794 and 5,389,506, Evans et al U.S. Pat. No. 5,389,503, Simons et al U.S. Pat. No. 5,391,443, Simons U.S. Pat. No. 5,418,119 and Gasper et al U.S. Pat. No. 5,420,003.

It has been a long standing practice in the art to modify an edge of color recording film to provide an information record entirely separate from the color image record. For example, edge sound tracks are frequently provided on motion picture films. Modified edge region constructions are illustrated by *Research Disclosure,* Item 38957, XIV. Scan facilitating features, Paragraph (3).

As an alternative to constructing a full color recording photographic element with single blue, green and red recording layer units, it is common practice to provide two or even three layer units for recording in the same region of the spectrum. The most common reason for these constructions is to allow the fastest emulsion for recording in a particular region of the spectrum to receive exposing light prior to transmission through the slower emulsion layers of other layer units. This increases speed and image sharpness. Color recording photographic elements having varied arrangements of layer units, including at least two separate layer units for recording exposure to the same region of the spectrum are illustrated by *Research Disclosure,* Item 38957, XI. Layers and layer arrangements.

The following are illustrative of only a few of the many possible additional layer unit sequences including at least two layer units for recording exposures to the same region of the spectrum:

| | |
|---|---|
| SQ-7 | $\|B\|G_f\|R_f\|G_s\|R_s\|S\|$, |
| SQ-8 | $\|B_f\|G_f\|R_f\|B_s\|G_s\|R_s\|S\|$, |
| SQ-9 | $\|B\|G_f\|R_f\|G_m\|R_m\|G_s\|R_s\|S\|$, |
| SQ-10 | $\|G_f\|R_f\|B_f\|G_s\|R_s\|B_s\|S\|$, |
| SQ-11 | $\|G_f\|R_f\|B_f\|G_m\|R_m\|B_m\|G_s\|R_s\|B_s\|S\|$, and |
| SQ-12 | $\|R_f\|B\|G_f\|R_f\|G_s\|R_s\|S\|$ |

where

B, G, R and S are as defined above, f=higher or highest speed of layer units recording in the same region of the spectrum, m=intermediate speed of layer units recording in the same region of the spectrum, s=slower or slowest speed of layer units recording in the same region of the spectrum.

In SQ-12 two $R_f$ layer units are shown. The $R_f$ layer unit farthest from the support contains a much lower silver halide coating coverage than the remaining $R_f$ layer unit and is sometimes referred to as a skim coat. Its function is offer a small speed boost to the red record to compensate for the otherwise less favorable for speed and sharpness locations of the red recording layer units as compared to the green recording layer units.

More specific illustrations of full color recording layer units that can be readily modified by the inclusion of one or more invention emulsions are provided by *Research Disclosure,* Item 37038

XIX. Color Negative Example 1

XX. Color Negative Example 2

XXI. Color Reversal Example 1

XXII. Color Reversal Example 2

Full color recording photographic elements are typically employed to record exposures over the full range of the visible spectrum. Occasionally color recording photographic elements are employed to record also exposures in the near ultraviolet and/or near infrared portions of the spectrum. When this is undertaken, an additional layer unit can be provided for this purpose.

Any convenient conventional technique for imagewise exposing a dye image forning photographic element can be employed in exposing the photographic elements of the invention. Exposure (E), measured in lux-seconds, is the product of exposure intensity (I), measured in lux, and time of exposure (ti), measured in seconds:

$$E=(I)(ti).$$

Common photographic applications span exposures ranging from $10^{-5}$ to $10^{3}$ seconds, and even relatively inexpensive cameras can accommodate exposures ranging from $10^{-3}$ to $10^{2}$ seconds. According to the law of reciprocity, all combinations of varied exposure times and varied exposure intensities that produce the same product (i.e., the same exposure) result in the same image density. In fact, the performance of photographic elements shows varying levels of departure from the law of reciprocity, commonly referred to as reciprocity failure. For example, whereas, according to the law of reciprocity failure a plot of densities versus exposure times (ti), where overall exposure (E) is held constant should result in a curve of invariant density, in practice density variations (reciprocity failure) is observed. It has been observed quite unexpectedly, in comparing otherwise similar starch peptized high bromide {111} tabular grain emulsions with gelatin peptized high bromide {111} tabular grain emulsions, that the starch peptized emulsions exhibit significantly reduced reciprocity failure (i.e., more closely conform to the law of reciprocity.

Exposure of camera speed color recording photographic elements in limited use and recyclable cameras is specifically contemplated. Limited use camera and incorporated film constructions are the specific subject matter of Item 338957, Section XVI Exposure, cited above, paragraph (2).

Although *Research Disclosure,* Items 36544 and 37038, have been used to provide specific illustrations of conventional photographic element features as well as their exposure and processing, it is recognized that numerous other publications also disclose conventional features, including the following:

James *The Theory of the Photographic Process,* 4th Ed., Macmillan, New York, 1977;

*The Kirk-Othmer Encyclopedia of Chemical Technology,* John Wiley and Sons, New York, 1993;

Neblette's *Imaging Processes and Materials,* Van Nostrand Reinhold, New York 1988; and Keller, *Science and Technology of Photography,* VCH, New York, 1993.

James *The Theory of the Photographic Process,* 4th Ed., Macmillan, New York, 1977;

The Kirk-Othmer *Encyclopedia of Chemical Technology,* John Wiley and Sons, New York, 1993;

Neblette's *Imaging Processes and Materials,* Van Nostrand Reinhold, New York 1988; and Keller, *Science and Technology of Photography,* VCH, New York, 1993.

EXAMPLES

The invention can be better appreciated by reference to the following specific embodiments.

Example 1

This example has as its purpose to demonstrate the advantage in speed demonstrated by a FED sensitized cationic starch peptized high bromide {111} tabular grain emulsion as compared to a similarly prepared emulsion, but prepared using a gelatino-peptizer.

Emulsion S1 (example)

A starch solution was prepared by heating at 85° C. for 45 min a stirred mixture of 8 L distilled water and 160 g of an oxidized cationic waxy corn starch. (The starch derivative, STA-LOK® 140 is 100% amylopectin that had been treated to contain quaternary ammonium groups and oxidized with 2 wt % chlorine bleach. It contains 0.31 wt % nitrogen and 0.00 wt % phosphorous. It was obtained from A. E. Staley Manufacturing Co., Decatur, Ill.) After cooling to 40° C., the weight was adjusted to 8.0 kg with distilled water, 26.5 mL of a 2 M NaBr solution was added, then while maintaining the pH at 5.0, 2.0 mL of saturated bromine water (~0.9 mmole) was added dropwise just prior to use.

To a vigorously stirred reaction vessel of the starch solution at 40° C. and maintained at pH 5.0 throughout the emulsion precipitation, a 2.5 M $AgNO_3$ solution was added at 200 mL per min for 21 sec. Concurrently, a salt solution of 2.5 M NaBr and 0.4 g/L bromine was added initially at 200 mL per min and then at a rate needed to maintain a pBr of 2.11. Then the addition of the solutions was stopped, 94 mL of the salt solution was added in 1 min and the temperature of the contents of the reaction vessel was increased to 60° C. at a rate of 1.67° C. per min. After holding at 60° C. for 10 min, 240 mL of the $AgNO_3$ solution was added at 10 mL per min for 1 min then its addition rate was accelerated to 19 mL per min in 12 min. The salt solution was concurrently added at a rate needed to maintain a constant pBr of 1.44. The additions were stopped and 40 mL of a buffer solution consisting of 2.94 M sodium acetate and 1.00 M acetic acid was added. Then the addition of the $AgNO_3$ solution was accelerated from 19 to 54 mL per min in 45 min and then held at this flow rate until a total of 2.4 L of $AgNO_3$ solution had been added. A solution of 2.5 M NaBr, 0.04 M KI and 0.45 g per L of bromine was concurrently added to maintain a pBr of 1.44. The total making time of the emulsion was ~87 min.

The resulting tabular grain emulsion was washed by ultrafiltration at 40° C. to a pBr of 3.26. Then 27 g of bone gelatin (methionine content ~55 micromole per g gelatin) per mole silver was added.

The {111} tabular grains had an average equivalent circular diameter of 3.8 μm, an average thickness of 0.07 μm, and an average aspect ratio of 54. The tabular grain population made up 99% of the total projected area of the emulsion grains.

Emulsion G1 (control)

To a solution of 10 g low methionine bone gelatin (methionine content<3 micromole per g gelatin), in 7.0 L distilled water and 46 mmole of NaBr at 40° C., pH 5.0 was added 0.10 mL of bromine water. To a vigorously stirred reaction vessel of this gelatin solution at 40° C., maintained at pH 5.0 throughout the precipitation, a 2.5 M $AgNO_3$ solution was added at 200 mL per min for 21 sec. Concurrently, a salt solution of 2.5 M NaBr and 0.4 g/L bromine was added initially at 200 mL per min and then at a rate needed to maintain a pBr of 2.11. Then the addition of the solutions was stopped, 82 mL of the salt solution was added in 1 min and the temperature of the contents of the reaction vessel was increased to 60° C. at a rate of 1.67° C. per min. Then all but 1.750 kg of the seed emulsion (0.042 mole Ag) was discarded. After the seed emulsion was at 60° C. for a total of 22 min, a solution preheated to 60° C. containing 100 g of oxidized bone gelatin, 1 L distilled water, 15.3 mL of 2 M NaBr and pretreated at 40° C. with 2.0 mL of bromine water was added. Then at 60° C., the $AgNO_3$ solution was added at 1.0 mL per min for 1 min then accelerated to 25 mL per min in 150 min and held at this flow rate until a total of 2,453 mL of the $AgNO_3$ solution was used. The salt solution was concurrently added until 240 mL of the $AgNO_3$ solution had been added, then a new salt solution of 2.5 M NaBr, 0.04 M KI to which 0.45 g per L of bromine was added was used to maintain a pBr of 1.44 throughout the rest of the precipitation. The total making time of the emulsion was 194 min. The emulsion was cooled to 40° C. and ultrafiltered to a pBr of 3.26. Then 12.4 g per mole silver of bone gelatin (methionine content ~55 micromole per g gelatin) was added.

The resulting tabular grain emulsion was similar to Emulsion S1 in the measured grain parameters of average ECD, thickness, and proportion of tabular grains as a percentage of total grain projected area.

Epitaxy

Epitaxy was deposited on the grains of each of Emulsions S1 and G1 by the following procedure: A vigorously stirred 1.0 mole aliquot of the emulsion was adjusted to a pAg of 7.59 at 40° C. by the addition of 0.25 M $AgNO_3$ solution. Then 5 mL of a 1M KI solution was added followed by 11 mL of a 3.77 M NaCI solution. Then the blue spectral sensitizing dye, anhydro-5,5'-dichloro-3,3,'-bis(3-sulfopropyl)thiacyanine hydroxide, triethylammonium salt, was added in the form of a gelatin-dye dispersion in an amount of 80% of the saturation coverage of the grains' surfaces. After stirring for 25 min, 84 mL of a 0.25 M NaCl solution and 84 mL of a 0.25 M NaBr solution were added followed by 8 mmole of an AgI fine grain (~0.05 μm) emulsion. To this mixture with vigorous stirring was added 0.5 M $AgNO_3$ at 76 mL per min for 1.1 min.

Electron microscopy analysis of the resulting emulsions showed the tabular grains had epitaxial deposits located primarily at the tabular grain corners and edges. As formulated these deposits had a nominal halide composition of 42 M% chloride, 42 M% bromide, and 16 M% iodide, based on silver.

Chemical Sensitization

To each of Emulsions S1 and G1 with epitaxy were added with stirring at 40° C. solutions of (amount per mole silver) NaSCN (0.925 mmole), 1,3-dicarboxymethyl-1,3-dimethyl-2-thiourea, (the optimized level for each emulsion was found to be the same, 7.8 micromole), bis(1,4,5-trimethyl-1,2,4-triazolium-3-thiolate) gold(I) tetrafluoroborate (the optimized level for each emulsion was found to be the same, 1.5 micromole), 3-{3-[(methylsulfonyl)amino]-3--oxopropyl} benzothiazolium tetrafluoroborate (the optimized level for each emulsion was found to be the same, 81 micromole). The emulsions were then heated at 50° C. for 10 minutes, cooled to 40° C., then sequentially 1-(3-acetamidophenyl)-5-mercaptotetrazole (0.489 mmole), FED 2 (2.8 micromole), and 4-hydroxy-6-methyl-1,3,3a,7-tetraazaindene (10 mmole ) were added.

Performance Comparison

Each of sensitized Emulsions 1 S and 1 G were coated on clear acetate support having an antihalation layer on the opposite side. The coatings had laydowns of 1.08 g/m$^2$ silver, 1.62 g/m$^2$ yellow dye-forming coupler, 3.2 g/m$^2$ gelatin and surfactant. A solution of gelatin and bis (vinylsulfonyl-methyl)ether were overcoated at 0.9 g/m$^2$ gelatin and 72 mg/ m$^2$ hardener, respectively. Each of the film coatings were exposed for 0.01 sec to a 5500 K color temperature tungsten light source filtered through a Kodak Wratten™ 2B filter and a 0 to 4 density step tablet. The exposed film coatings were processed using the Kodak Flexicolor™ C-41 color negative film process.

Minimum density ($D_{min}$), Gamma and Speed are compared below in Table III. Speed is reported as relative log speed, where a speed difference of 1 relative log speed difference is equal to an exposure difference of 0.01 log E, where E represents exposure in lux-seconds. Speed was measured on the characteristic curve at the intersection of the extrapolated straight line portion of the characteristic curve with the straight line extrapolation of the $D_{min}$ segment of the characteristic curve. Gamma is the slope of the straight line portion of the characteristic curve.

TABLE III

| Emulsion | $D_{min}$ | Gamma | Speed |
|---|---|---|---|
| S1 (example) | 0.13 | 1.80 | 130 |
| G1 (control) | 0.10 | 1.97 | 106 |

From Table III it is apparent that the cationic starch peptized high bromide {111} tabular grain Emulsion S1 was nearly a stop (0.30 log E) faster in speed than the comparable gelatin peptized Emulsion G1. A stop speed advantage translates to a doubling of speed. Specifically, the 24 higher relative log speed units of Emulsion S1 amounts of a speed advantage of 0.24 log E over Emulsion G1.

Example 2

In Example 1 the large speed advantage of Emulsion S1 over Emulsion G1 is in part attributable to the known speed advantage for substituting a cationic starch peptizer for gelatin and in part unexpected. This example has as its purpose to ascertain the extent of the speed advantage that results from substituting cationic starch peptizer for gelatino-peptizer, with no FED sensitizer present.

Emulsions S1 and G1 were remade as Emulsions S2 and G2 with these modifications: The FED sensitizer was omitted and the bromine oxidizing agent used to control elevated fog generated by FED sensitizer was also omitted. Repeating the performance comparison of Example 1, the following performance characteristics were noted:

TABLE IV

| Emulsion | $D_{min}$ | Gamma | Speed |
|---|---|---|---|
| S2 (no FED) | 0.11 | 1.85 | 107 |
| G2 (no FED) | 0.10 | 1.71 | 100 |

The speeds reported in Tables III and IV are all referenced to Emulsion G2. From Table IV it is apparent that the substitution of cationic starch peptizer for gelatin produces a speed advantage, previously known in the art, of 0.07 log E. Subtracting this expected speed advantage from the 0.24 log E speed advantage observed for Emulsion S1, indicates an unexpected added speed advantage when FED sensitizer is present of 0.17 log E (approximately one half stop, 0.15 log E).

Example 3

This example has as its purpose to demonstrate the advantage in minimum density attributable to the presence of the oxidizing agent during grain precipitation in Emulsion S1.

An emulsion satisfying the requirements of the invention, Emulsion S3, was precipitated similarly as Emulsion S1, except that the bromine oxidizing agent added during precipitation was omitted. In all other respects Example 1 was repeated. The reported grain parameters of Emulsions S1 and S3 were similar. The performance of Emulsions S1, G1 and S2 are compared in Table V.

TABLE V

| Emulsion | $D_{min}$ | Gamma | Speed |
|---|---|---|---|
| S1 (example) | 0.13 | 1.80 | 130 |
| G1 (control) | 0.10 | 1.97 | 106 |
| S3 (example) | 0.21 | 1.80 | 126 |

From Table V it is apparent that, in the absence of the bromine oxidizing agent, a large unexpected speed advantage remains in evidence attributable to the combination of cationic starch peptizer and FED sensitizer. The disadvantage of omitting the oxidizing agent is a 0.11 increase in $D_{min}$. This increase in minimum density, can be accommodated in some applications, such as color negative imaging, but would be objectionable in a color print, for instance. Hence, use of the oxidizing agent is preferred, but not required.

Example 4

This example has as its purpose to demonstrate that delaying oxidizing agent addition until after precipitation is effective.

Example 1 was repeated as applied to Emulsion S1, but with the difference that bromine was absent from the emulsion during precipitation, but was added subsequent to precipitation by the following procedure:

Example Emulsion S4 was prepared similarly to that of Emulsion S1, except that no bromine was used before or during the precipitation. After the precipitation was complete, 28 mL of saturated bromine water (~0.013 mole) was added to the stirred emulsion at 40° C. maintaining the pH at 5.0 with dilute NaOH solution. (The reaction was over within 2 min after the bromine water addition, as indicated by the amount of NaOH that was needed to maintain the pH at 5.0.) The emulsion was ultrafiltered.

The measured grain parameters of Example Emulsions S1 and S4 were identical. The performance of Emulsions S1, S3 and S4 are compared in Table VI.

TABLE VI

| Emulsion | $D_{min}$ | Gamma | Speed |
|---|---|---|---|
| S1 (pptn Br) | 0.13 | 1.80 | 130 |
| S3 (no Br) | 0.21 | 1.80 | 126 |
| S4 (post pptn Br) | 0.16 | 1.69 | 130 |

From Table VI it is apparent that bromine added following precipitation (pptn) is effective in limiting minimum density, although not as effective a bromine added during precipitation. The unexpected speed advantage of employing a cationic starch peptizer in combination with a FED sensitizer is observed in each of Emulsions S1, S3 and S4.

Example 5

This example has as its purpose to demonstrate the further increase in the speed that is realized when a one equivalent image dye-forming coupler is substituted for a two equivalent image-dye-forming coupler used with a FED sensitized cationic starch peptized high bromide {111} tabular grain emulsion.

Coating C1

Example 1 was repeated using emulsion S3, except that the two equivalent image yellow dye-forming coupler N-{2-chloro-5-[(hexadecyl-sulfonyl)amino]phenyl}-2-{4-[(4-hydroxyphenyl)sulfonyl]phenoxy}-4,4-dimethyl-3-oxo-pentanamide was substituted for the yellow dye-forming coupler of Example 1 and the gelatin coating coverage was increased to 4.32 g/$m^2$.

Coating C2

This coating was identical to C1, except that emulsion S1 was substituted for emulsion S3.

Coating E3

This coating was identical to C1, except that 0.54 g/m2 of the one equivalent yellow dye-forming coupler OEC-10 was substituted for the yellow dye forming coupler of C1.

Coating E4

This coating was identical to E3, except that emulsion S1 was substituted for S3.

The results are summarized in Table VIII

| Coating | Oxidizing Agent | Coupler | $D_{min}$ | Gamma | Relative Speed |
|---|---|---|---|---|---|
| C1 | No | 2-eq. | 0.23 | 2.04 | 100 |
| C2 | Yes | 2-eq. | 0.19 | 1.96 | 105 |
| E3 | No | 1-eq. | 0.37 | 1.64 | 128 |
| E4 | Yes | 1-eq. | 0.22 | 1.70 | 132 |

From Table VIII it is apparent that the substitution of a one equivalent image dye-forming coupler for a two equivalent image dye-forming coupler resulted in a speed increase of 0.27 to 0.28 log E. Since a full stop (0.30 log E) speed increase is a doubling of speed, it is apparent that a very large increase in speed was realized attributable to the addition one equivalent image dye-forming coupler to the FED sensitized cationic starch peptized high bromide {111} tabular grain emulsion.

While minimum density was increased by the substitution of one equivalent image dye-forming coupler, with the use of the oxidizing agent only a 0.03 increase in minimum density was incurred in obtaining a 0.27 log E speed increase. That is, the increase in minimum density was quite small in relation to the speed advantage realized.

The invention has been described in detail with particular reference to certain preferred embodiments thereof, but it will be understood that variations and modifications can be effected within the spirit and scope of the invention.

What is claimed is:

1. A photographic recording element comprised of a support and at least one dye image forming layer unit containing (a) radiation-sensitive silver halide grains, (b) sensitizer for the silver halide grains, (c) peptizer for the silver halide grains, and (d) at least one dye image providing coupler,

WHEREIN (a) the radiation-sensitive silver halide grains include tabular grains (1) having {111} major faces, (2) containing greater than 50 mole percent bromide, based on silver, and (3) accounting for greater than 50 percent total grain projected area, (b) the sensitizer includes a fragmentable electron donating sensitizer, (c) the peptizer is a water dispersible cationic starch, and (d) the dye image providing coupler is comprised of a one equivalent image dye-forming coupler.

2. A photographic recording element according to claim 1 wherein the fragmentable electron donating sensitizer contains a moiety for promoting adsorption to silver halide grain surfaces.

3. A photographic recording element according to claim 1 wherein the radiation-sensitive silver halide grains include tabular grains containing greater than 70 mole percent bromide, based on silver, and account for greater than 70 percent of total grain projected area.

4. A photographic recording element according to claim 3 wherein the radiation-sensitive silver halide grains include tabular grains containing at least 90 moler percent bromide, based on silver, and account for at least 90 percent of total grain projected area.

5. A photographic recording element according to claim 1 wherein the fragmentable electron donating sensitizer satisfies the formula X—Y', X—Y' forming the entire sensitizer or a moiety —X—Y' of the sensitizer, wherein X is an electron donating compound moiety;

Y' is a proton or a leaving group Y; and wherein:

(1) X—Y' has an oxidation potential between 0 and about 1.4 V; and (2) the oxidized form of X—Y' undergoes a bond cleavage reaction to give the radical $X^{\bullet}$ and the leaving fragment Y'; and, optionally, (3) the radical $X^{\bullet}$ has an oxidation potential<−0.7 V.

6. A photographic recording element according to claim 1 wherein the cationic starch is a water dispersible oxidized cationic starch.

7. A photographic recording element according to claim 1 wherein the cationic starch contains α-D-glucopyranose repeating units and, on average, at least 1 percent of the α-D-glucopyranose repeating units are ring opened by oxidation.

8. A photographic recording element according to claim 1 wherein the one equivalent image dye-forming coupler satisfies the formula:

COUP-$L_n$-B-N($R^1$)-DYE wherein

COUP is an image dye-forming coupler moiety;

DYE is an image dye or image dye precursor;

B is —OC(O)—, —OC(S)—, —SC(O)—, —SC(S)— or —OC(=$NSO_2R$)—, where R is a substituted or unsubstituted alkyl or aryl group;

L is a linking group;

n is zero or 1; and $R^1$ is an alkyl or aromatic group.

9. A photographic recording element according to claim 8 wherein n is zero.

10. A photographic recording element according to claim 8 wherein B is —OC(O)—.

11. A photographic recording element according to claim 8 wherein DYE is an azomethine or methine dye.

12. A photographic element comprised of a transparent film support, blue, green and red recording layer units coated on the support for recording exposures to the blue, green and red regions of the visible spectrum, respectively, at least one of the recording layer units containing an emulsion according to any one of claims 1 to 11 inclusive.

* * * * *